US009839295B2

(12) United States Patent
Robinson et al.

(10) Patent No.: US 9,839,295 B2
(45) Date of Patent: Dec. 12, 2017

(54) DROP IN SEAT DECK FOR FURNITURE ASSEMBLIES

(71) Applicant: ASHLEY FURNITURE INDUSTRIES, INC., Arcadia, WI (US)

(72) Inventors: Nicholas J. Robinson, Ettrick, WI (US); Timothy A. Brandtner, Ettrick, WI (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 221 days.

(21) Appl. No.: 14/695,491

(22) Filed: Apr. 24, 2015

(65) Prior Publication Data

US 2015/0305504 A1 Oct. 29, 2015

Related U.S. Application Data

(60) Provisional application No. 61/983,771, filed on Apr. 24, 2014.

(51) Int. Cl.
*A47C 7/02* (2006.01)
*A47C 7/16* (2006.01)
(Continued)

(52) U.S. Cl.
CPC ..... *A47C 7/025* (2013.01); *A47C 3/00* (2013.01); *A47C 5/12* (2013.01); *A47C 7/16* (2013.01); *A47C 17/02* (2013.01)

(58) Field of Classification Search
CPC ..... A47C 7/025; A47C 7/028; A47C 7/28; A47C 7/027; A47C 7/16
See application file for complete search history.

(56) References Cited

U.S. PATENT DOCUMENTS 356,049 A 1/1887 Oakes
389,292 A 9/1888 Flohr
(Continued)

FOREIGN PATENT DOCUMENTS

CN 101708095 A 5/2010
DE 30 33 267 A1 4/1982
(Continued)

OTHER PUBLICATIONS

Notice of Acceptance, Australian Patent Application No. 2015249306, dated Mar. 29, 2017.

*Primary Examiner* — Timothy J Brindley
(74) *Attorney, Agent, or Firm* — Christensen, Fonder, Dardi & Herbert PLLC

(57) ABSTRACT

A drop-in seat deck for furniture assemblies. Various embodiments reduce the complexity and bulk of the seating frame, and also reduce the labor associated with assembly. Unlike the conventional spring suspensions, which apply constant spring loaded forces on the frame rails to maintain the springs in tension, the spring load force of the disclosed drop-in seat deck is provided by solely by the structure of the drop-in seat deck. Thus, the frame can be designed to support only the weight of the seated person is transferred to the rails of the seating frame, without consideration for pre-loading the seat deck. In various embodiments, dimensional changes to the seat deck occur under load. In some embodiments, these changes are accommodated by enabling a free end of the seat deck to slide on a support surface; in other embodiments, the changes are accommodated by flexures that are integral to the seat deck.

12 Claims, 20 Drawing Sheets

(51) Int. Cl.

| | |
|---|---|
| ***A47C 3/00*** | (2006.01) |
| ***A47C 5/12*** | (2006.01) |
| ***A47C 17/02*** | (2006.01) |

(56) References Cited

U.S. PATENT DOCUMENTS 531,370 A * 12/1894 Freese ..... A47C 23/06 5/236.1
544,615 A * 8/1895 Fraser ..... A47C 23/06 5/207
577,780 A * 2/1897 Peterson ..... A47C 23/06 5/208
587,864 A * 8/1897 Ryan et al. ..... A47C 23/06 5/236.1
589,239 A 8/1897 Bent
593,824 A * 11/1897 Tinkam ..... A47C 23/06 5/209
1,668,473 A 5/1928 Weickman et al.
2,126,439 A 8/1938 Zerbee
2,202,301 A 5/1940 Probst
2,217,893 A 10/1940 Dunajeff
2,302,479 A 11/1942 Tallmadge
2,316,628 A 4/1943 Schaffner
2,324,318 A 7/1943 Niedringhaus
2,393,349 A 1/1946 Weingarten
2,398,769 A 4/1946 Ceslowitz
2,485,443 A 10/1949 Hathaway
2,619,656 A 12/1952 Crahan
2,646,108 A 7/1953 Norman
2,652,885 A * 9/1953 Engel ..... A47C 23/02 267/103
2,678,685 A 5/1954 Volsk
2,722,267 A 11/1955 Liljengren
2,806,513 A 9/1957 Zerbee
2,833,339 A 5/1958 Liljengren
2,893,476 A 7/1959 Liljengren
2,968,340 A 1/1961 Metzner
3,084,980 A 4/1963 Lawson
3,095,238 A 6/1963 Tarascon
3,114,578 A * 12/1963 Hamilton ..... A47C 7/028 211/182
3,117,775 A 1/1964 Hamilton et al.
3,156,460 A 11/1964 Santillo
3,209,379 A * 10/1965 Reinhold ..... A47C 20/043 267/110
3,210,064 A 10/1965 Crosby
3,224,017 A 12/1965 Zerbee
3,275,357 A 9/1966 Tabor
3,276,765 A 10/1966 Slominski et al.
3,315,283 A 4/1967 Larsen
3,329,466 A 7/1967 Getz et al.
3,393,940 A * 7/1968 Ellsworth ..... A47C 7/028 297/239
3,408,666 A * 11/1968 Harris ..... A47C 23/02 5/305
3,497,883 A 3/1970 Arnold et al.
3,610,688 A 10/1971 Arnold et al.
3,636,574 A 1/1972 Kramer
3,716,875 A 2/1973 Fehr
3,720,568 A 3/1973 Rowland
3,768,795 A 10/1973 Rathbun, Jr.
3,842,452 A * 10/1974 Kievits ..... A47C 23/061 267/81
3,860,287 A 1/1975 Platt
3,902,756 A 9/1975 Chubb
3,915,493 A 10/1975 Brown
3,981,537 A 9/1976 Wright
4,036,526 A 7/1977 Baechle et al.
4,222,134 A 9/1980 Degen
4,236,260 A 12/1980 Mizelle
4,285,080 A 8/1981 Kitchen et al.
4,369,534 A 1/1983 Wright
4,369,535 A 1/1983 Ekkerink
4,502,731 A 3/1985 Snider
4,541,133 A 9/1985 Reiss et al.
4,567,615 A 2/1986 Fanti
4,644,596 A 2/1987 Hüsler
4,688,778 A 8/1987 Woltron
4,703,526 A 11/1987 Degen
4,704,751 A 11/1987 Guerra
4,768,244 A 9/1988 Riedl
4,815,717 A 3/1989 Crosby
4,827,544 A 5/1989 Hüsler
4,858,258 A 8/1989 Mizelle
4,935,977 A 6/1990 Yamada
5,022,709 A 6/1991 Marchino
5,058,223 A 10/1991 Vasquez
5,076,643 A 12/1991 Colasanti et al.
5,154,485 A 10/1992 Fleishman
5,155,881 A 10/1992 Lafferty
5,188,343 A 2/1993 Galea
5,253,851 A 10/1993 Fontana
5,257,424 A 11/1993 Rogers
5,269,497 A 12/1993 Barth
5,282,285 A 2/1994 de Gelis et al.
5,570,874 A 11/1996 Tornero
5,588,165 A 12/1996 Fromme
5,624,161 A 4/1997 Sorimachi et al.
5,658,049 A 8/1997 Adams et al.
5,747,140 A 5/1998 Heerklotz
5,878,451 A 3/1999 Lumine
6,003,178 A * 12/1999 Montoni ..... A47C 23/06 5/241
6,039,404 A 3/2000 Fontana
6,082,825 A 7/2000 Simon
6,116,694 A 9/2000 Bullard
6,170,808 B1 1/2001 Kutschi
6,193,318 B1 2/2001 Becker et al.
6,219,863 B1 4/2001 Loberg et al.
6,256,815 B1 7/2001 Degen
6,263,573 B1 7/2001 Bullard
6,299,150 B1 10/2001 Allen et al.
6,477,727 B1 11/2002 Fromme
6,565,157 B2 5/2003 Barile, Jr. et al.
6,651,276 B2 11/2003 McCraw et al.
6,692,080 B1 2/2004 Bullard
6,701,551 B1 3/2004 Antinori
6,736,459 B1 5/2004 Sturt
6,739,672 B2 5/2004 Bullard
6,793,289 B2 9/2004 Kuster et al.
6,832,401 B2 12/2004 Setzer
6,859,959 B2 3/2005 Fromme
7,159,255 B2 1/2007 Piraino
7,269,865 B2 9/2007 James et al.
7,338,039 B2 3/2008 Pfau et al.
7,353,553 B2 4/2008 Huse
7,398,567 B2 7/2008 Leng
7,438,362 B2 10/2008 Dotta et al.
7,441,758 B2 10/2008 Coffield et al.
7,568,769 B1 * 8/2009 Chuang ..... A47C 7/024 297/452.58
7,832,040 B2 11/2010 Constantinescu et al.
7,861,333 B2 1/2011 Grossman et al.
7,874,343 B2 1/2011 Hansen
7,926,880 B2 4/2011 Heidmann et al.
8,136,884 B2 3/2012 Bullard et al.
8,185,985 B2 5/2012 Coffield et al.
8,322,168 B2 12/2012 Wall et al.
8,411,654 B2 4/2013 Loc et al.
8,534,648 B2 9/2013 Coffield et al.
9,560,916 B1 * 2/2017 Bullard ..... A47C 7/22
2002/0100119 A1 * 8/2002 Constantinescu ..... A47C 23/02 5/247
2003/0028963 A1 2/2003 McCraw et al.
2004/0137811 A1 7/2004 Tornero
2005/0039258 A1 * 2/2005 Gavela Vazquez .. A47C 19/005 5/400
2005/0279591 A1 12/2005 Coffield et al.
2006/0150327 A1 7/2006 Jansen et al.
2006/0267258 A1 11/2006 Coffield et al.
2006/0286359 A1 12/2006 Coffield et al.
2007/0000047 A1 1/2007 James et al.
2007/0000060 A1 1/2007 Firestone

(56) References Cited

U.S. PATENT DOCUMENTS

| | | | | |
|---|---|---|---|---|
| 2007/0040311 | A1 | 2/2007 | Maas | |
| 2007/0267912 | A1 | 11/2007 | Britton et al. | |
| 2008/0185760 | A1 | 8/2008 | Jansen | |
| 2009/0020931 | A1 | 1/2009 | Coffield et al. | |
| 2009/0020932 | A1 | 1/2009 | Coffield et al. | |
| 2009/0025142 | A1* | 1/2009 | Grossman | A47C 17/1753 5/37.1 |
| 2009/0102269 | A1 | 4/2009 | Dotta et al. | |
| 2009/0183311 | A1* | 7/2009 | Nguyen | A47C 19/005 5/174 |
| 2009/0217454 | A1* | 9/2009 | Wranne | A47C 23/061 5/191 |
| 2010/0117419 | A1* | 5/2010 | Schmitz | A47C 1/03255 297/284.1 |
| 2010/0283308 | A1* | 11/2010 | Deskevich | A47C 5/12 297/451.11 |
| 2010/0293772 | A1 | 11/2010 | Pan | |
| 2011/0031665 | A1 | 2/2011 | DeFranks | |
| 2011/0101744 | A1* | 5/2011 | Naughton | B29C 44/1238 297/216.1 |
| 2011/0185497 | A1 | 8/2011 | Grossman et al. | |
| 2012/0168997 | A1 | 7/2012 | Jansen | |
| 2012/0256467 | A1 | 10/2012 | Pettingill et al. | |
| 2013/0334747 | A1 | 12/2013 | Spinks | |
| 2015/0167768 | A1* | 6/2015 | Zhao | F16F 1/368 267/164 |

FOREIGN PATENT DOCUMENTS

| | | | |
|---|---|---|---|
| DE | 40 07 570 | A1 | 9/1990 |
| DE | 39 36 788 | | 5/1991 |
| DE | 299 16 728 | U1 | 1/2000 |
| DE | 202 09 330 | U1 | 8/2002 |
| DE | 10 2011 002 160 | A1 | 10/2012 |
| DE | 102013014296 | A1 | 2/2015 |
| EP | 0 572 895 | A1 | 6/1996 |
| EP | 0 824 881 | A2 | 2/1998 |
| EP | 1 118 290 | A1 | 7/2001 |
| EP | 1 955 613 | A1 | 8/2008 |
| EP | 2 225 973 | A2 | 9/2010 |
| FR | 2605261 | A1 | 4/1988 |
| FR | 2664144 | A1 | 1/1992 |
| GB | 2255095 | A | 10/1992 |
| JP | H 06-189839 | A | 7/1994 |
| JP | 2005-152277 | A | 6/2005 |
| WO | WO 03/092445 | A1 | 11/2003 |
| WO | WO 2004/021839 | A1 | 3/2004 |
| WO | WO 2007/005850 | A2 | 1/2007 |
| WO | WO 2011/103852 | A2 | 9/2011 |

* cited by examiner

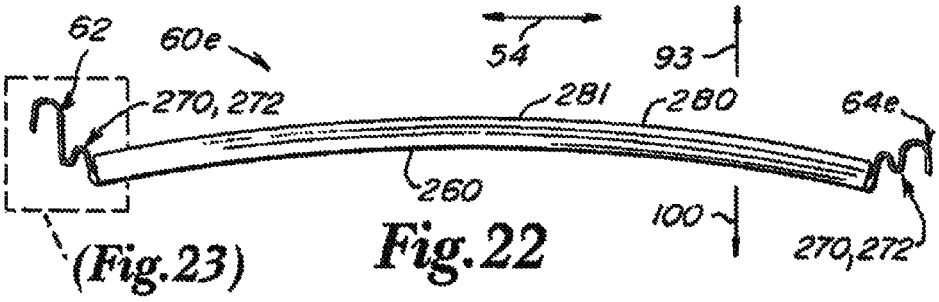
Fig.22
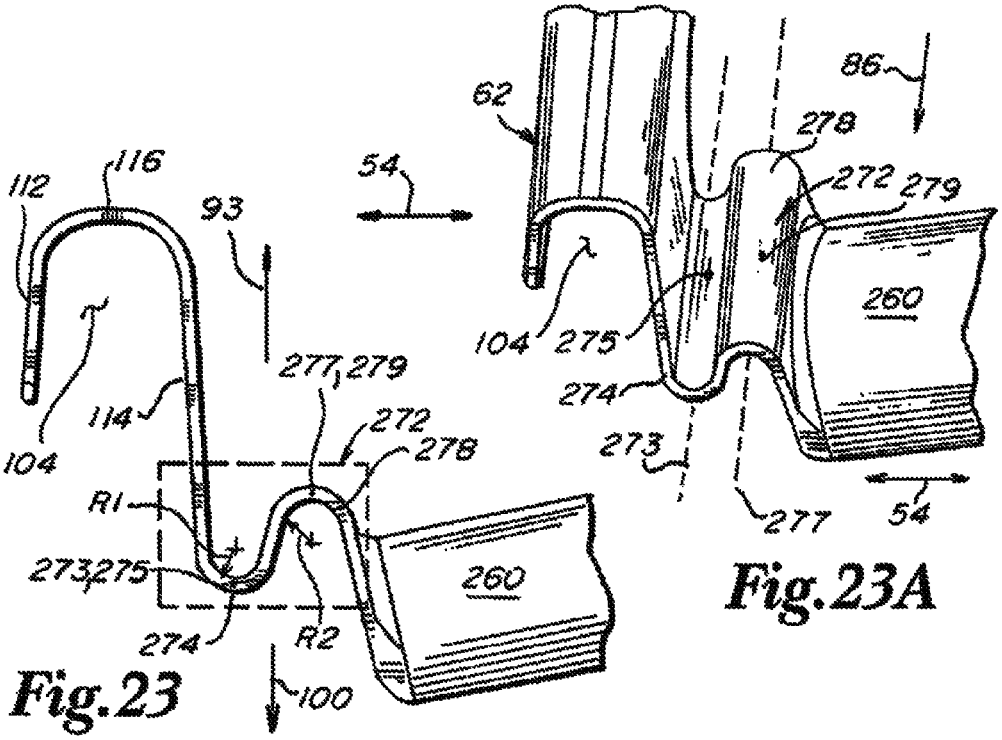
Fig.23
Fig.23A
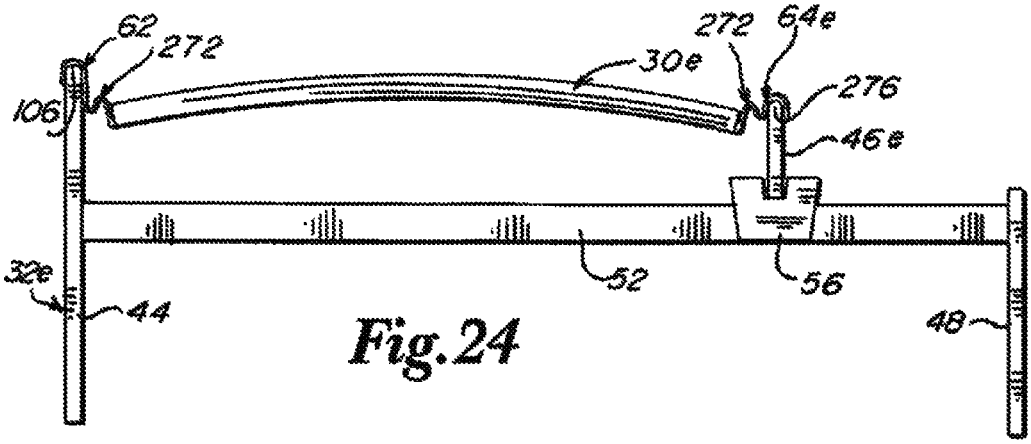
Fig.24

DROP IN SEAT DECK FOR FURNITURE ASSEMBLIES

RELATED APPLICATIONS

This application claims the benefit of U.S. Provisional Patent Application No. 61/983,771, filed Apr. 24, 2014, the disclosure of which is incorporated by reference herein in its entirety.

FIELD OF THE DISCLOSURE

The disclosure is directed generally to furniture assemblies and more specifically to a seat deck installed in the furniture assemblies that supports the weight of the occupant.

BACKGROUND OF THE DISCLOSURE

Conventional loaded spring suspensions that support seat cushions in sofas and chairs and the like typically include webbing and spring systems that are incorporated by securing the periphery of the suspensions to the front, back and side rails of the seating frame. The spring suspensions require numerous parts and structures that comprise a degree of complexity and require substantial labor in assembly. Also, in the attachment of the suspensions to the seating frame, the spring components are stretched during attachment to the frame rails. The tension loading and attachment of the springs requires significant work and, when in place, applies a significant force on the rails, thereby stressing the rails and the connections between the rails. The load and stress remain in the final construction. Accordingly, the seating frame must be engineered to accommodate the rigors of applying the tension loads and to sustain the tension loads over the life of the furniture item.

An apparatus and method for applying the tension load to spring components is presented, for example, in U.S. Pat. No. 7,438,362 to Dotta et al., assigned to the owner of the present application, the contents of which are hereby incorporated by reference herein except for express definitions and patent claims contained therein.

A seating system that reduces the complexity and bulk of the seating frame as well as the labor associated with assembly would be welcomed.

SUMMARY OF THE DISCLOSURE

Various embodiments of the disclosure include a drop-in seat deck that reduces complexity and bulk of the seating frame, and also reduces the labor associated with assembly. Unlike the conventional spring suspensions, which apply constant spring loaded forces on the frame rails to maintain the springs in tension, the spring load force of the disclosed "drop-in" seat deck is provided by solely by the structure of the seat deck, without need for imparting tension loads across the span of the seating frame. Thus, only the weight of the seated person is transferred to the rails of the seating frame. Accordingly, many of the complexities and structural requirements associated with the seating frames of conventional designs are averted. The design of the seat deck can also provide for a more consistent suspension in the direction from side rail to side rail.

Various embodiments present an arcuate profile that is convex in an upward direction, as viewed from the side. Under a weight load, the convex dimension of the arcuate profile reduces, causing the dimension of the seat deck to increase in a fore-and-aft direction. In some embodiments, the change in the fore-and-aft dimension of the seat deck is accommodated by enabling one end of the seat deck so slide on the surface of a support. In other embodiments, the seat deck includes flexures that accommodate the change in the fore-and-aft directions.

Structurally, in various embodiments, a furniture assembly is disclosed, comprising a seating frame including a first support member and a second support member, the first support member and the second support member being substantially parallel and extending in a lateral direction. In some embodiments, a seat deck comprises a composite polymer material and including a first edge structure and a second edge structure, the first edge structure defining a channel dimensioned to capture an upper edge of the first support member, the first edge structure being fixedly attached to the first support member of the furniture assembly. In certain embodiments, the seat deck includes an elongated slat member that is coupled to the first edge structure and the second edge structure, the elongated slat member extending between the first edge structure and the second edge structure in a fore-and-aft direction that is perpendicular to the lateral direction. The elongate slat member defines a convex arcuate profile that is convex in an upward direction, the convex arcuate profile defining a local maxima of the elongate slat member.

In some embodiments, the elongated slat member is one of a plurality of elongated slat members of the seat deck, the plurality of elongated slat members extending in the fore-and-aft direction, the seat deck including lateral tie members that tie the plurality of elongated slat members together in the lateral direction. In one embodiment, the plurality of elongated slat members are unitary with the second edge structure. In various embodiments, the second edge structure defines a channel dimensioned to capture an upper edge of the second support member, the second edge structure being fixedly attached to the second support member of the furniture assembly.

In various embodiments of the disclosure, the seat deck includes flexures that bridge the elongated slat member to the first edge structure and the second edge structure, the flexures being configured to accommodate a change in a length of the seat deck in the fore-and-aft directions when the seat deck is under a weight load. The flexures can, in certain embodiments, be configured to accommodate a maximum change in the length of the seat deck in the fore-and-aft directions, thereby enabling the elongated slat member to transition from the convex arcuate profile to an inverted profile that defines a concavity. For various embodiments, at least one of the flexures is defines a node and a flexure axis that passes through the node, the flexure being configured to flex about the node and the flexure axis when a force component is exerted on the at least one of the flexures in the fore-and-aft directions. In some embodiments, the flexure axis is orthogonal to the fore-and-aft directions. The flexure axis can also be substantially parallel to the lateral direction.

In some embodiments, the at least one of the flexures can define a second node and a second flexure axis that passes through the second node, the at least one of the flexures being configured to flex about the second node and the second flexure axis when the force component is exerted on the at least one of the flexures in the fore-and-aft directions. In one embodiment, the second flexure axis is parallel to the flexure axis. In certain embodiments, the at least one of the flexures is an S-shaped flexure. In various embodiments, the at least one of the flexures is configured to provide a stop in the fore-and-aft directions to limit deflection of the elongated slat member in a downward direction. In one embodiment, the at least one of the flexures is a canted arm flexure configured to stop against the seating frame.

In various embodiments of the disclosure, a furniture assembly is disclosed, comprising a seating frame including a first support member and a second support member, the first support member and the second support member being substantially parallel and extending in a lateral direction. In some embodiments, a unitary seat deck is included comprising a composite polymer material and including a first edge structure and a second edge structure, the first edge structure being configured to mount an upper edge of the first support member, the second edge structure being configured to mount an upper edge of the second support member, the first edge structure being fixedly attached to the first support member, the second edge structure being fixedly attached to the second support member, the seat deck including a plurality of elongated slat members that are coupled to the first edge structure and the second edge structure, the plurality of elongated slat members extending between the first edge structure and the second edge structure in a fore-and-aft direction that is perpendicular to the lateral direction. In some embodiments, each of the plurality of elongated slat members define a convex arcuate profile that is convex in an upward direction, each of the plurality of elongated slat members defining a local maxima.

In various embodiments of the disclosure, a sofa is disclosed, comprising a seating frame including a first support member and a second support member, the second support member being substantially parallel to the first support member and including an upward-facing registration surface. A seat deck includes a first edge structure and a second edge structure, the first edge structure being fixedly attached to the first support member of the sofa, the second edge structure being registered on the upward-facing registration surface of the second support member of the sofa, the second edge being translatable on the upward-facing registration surface. In one embodiment, the seat deck includes a spanning portion that connects the first edge structure and the second edge structure, the spanning portion including a plurality of rib portions that extend in fore-and-aft directions from the first edge structure to the second edge structure. In some embodiments, the first edge structure defines a channel dimensioned to engage an upper edge of the first support member.

Each of the plurality of rib portions includes an arcuate edge that is integral with the spanning portion, the arcuate edge causing the spanning portion to conform to a convex arcuate contour that defines a local maxima between the first edge structure and the second edge structure. In one embodiment, the plurality of rib portions extend downward from the spanning portion. In one embodiment, the plurality of rib portions comprise two rib portions, each of the two rib portions extending substantially perpendicular to opposing lateral edges of the spanning portion.

In one embodiment, the spanning portion defines a plurality of through-apertures, the through apertures defining an open area of the spanning portion. The open area can vary along the fore-and-aft directions of the seat deck. The through-apertures can be elongated with major axes that extend parallel to the fore-and-aft directions. In one embodiment, the open area of the spanning portion is greater at a quarter span and a three-quarter span location along the fore-and-aft directions than at a mid-span location along the fore-and-aft directions.

The first support member can be a forward support member, and the second support member can be a rearward support member. In one embodiment, the forward support member is a forward-most member of the seating frame.

In various embodiments, the seat deck is injection molded and can comprise a composite material. The composite material can comprise a 10% to 20% glass filled polypropylene. Other fillers can include talc and calcium.

In some embodiments of the disclosure, each seat deck may be attached to a forward support member and a rearward support member and not attached to the fore-and-aft members of the furniture assembly framework. In some embodiments, a seat deck is attached forwardly and rearwardly on a support frame but not on the lateral edges. In an embodiment, a seat deck that is attached forwardly and rearwardly on a support frame but substantially not on the sides.

In some embodiments of the disclosure, a seat deck that is easily manufactures and easily handled with dimensions of at least 18 inches in depth and 18 inches in width. The seat decks may be installed side by side with a deck for each seating position. Each of the decks may be dropped into the framework and permanently fastened with staples or nails that may puncture nailing or stapling strips on the deck.

In various embodiments of the disclosure, the seat decks present an arcuate seating portion with a forward-rearward length extension and retraction capability on the furniture assembly, but not having a left to right width extension or retraction capability.

In some embodiments of the disclosure, the seat deck includes a seat engagement portion for receiving seat cushions and forward attachment structure for connection to the forward horizontal support member of the sofa frame and rearward attachment structure for attachment to the rearward horizontal support member of the sofa frame. In various embodiments, the seat deck does not include frame portions that extend in the fore-and-aft directions.

The seat decks can be characterized as having a plurality of nodes accommodating length extension and refraction of the seat decks, the nodes positioned on at least one of the forward and rearward attachment structures.

In some embodiments of the disclosure, sequential seat decks may be installed in an overlapping arrangement with adjacent seat decks, the overlapping arrangement extending forwardly and rearwardly.

BRIEF DESCRIPTION OF THE DRAWINGS

FIG. 22 is an elevational view of the seat deck of FIG. 20;

FIG. 23 is an enlarged view of a channel and S-shaped flexure of the seat deck of FIG. 22;

FIG. 23A is an enlarged, perspective view of the channel and S-shaped flexure of the seat deck of FIG. 22;

FIG. 24 is an elevational view of the seat deck of FIG. 22 in partial assembly with a sofa framework in an embodiment of the disclosure;

DETAILED DESCRIPTION OF THE DRAWINGS

Figure 1:
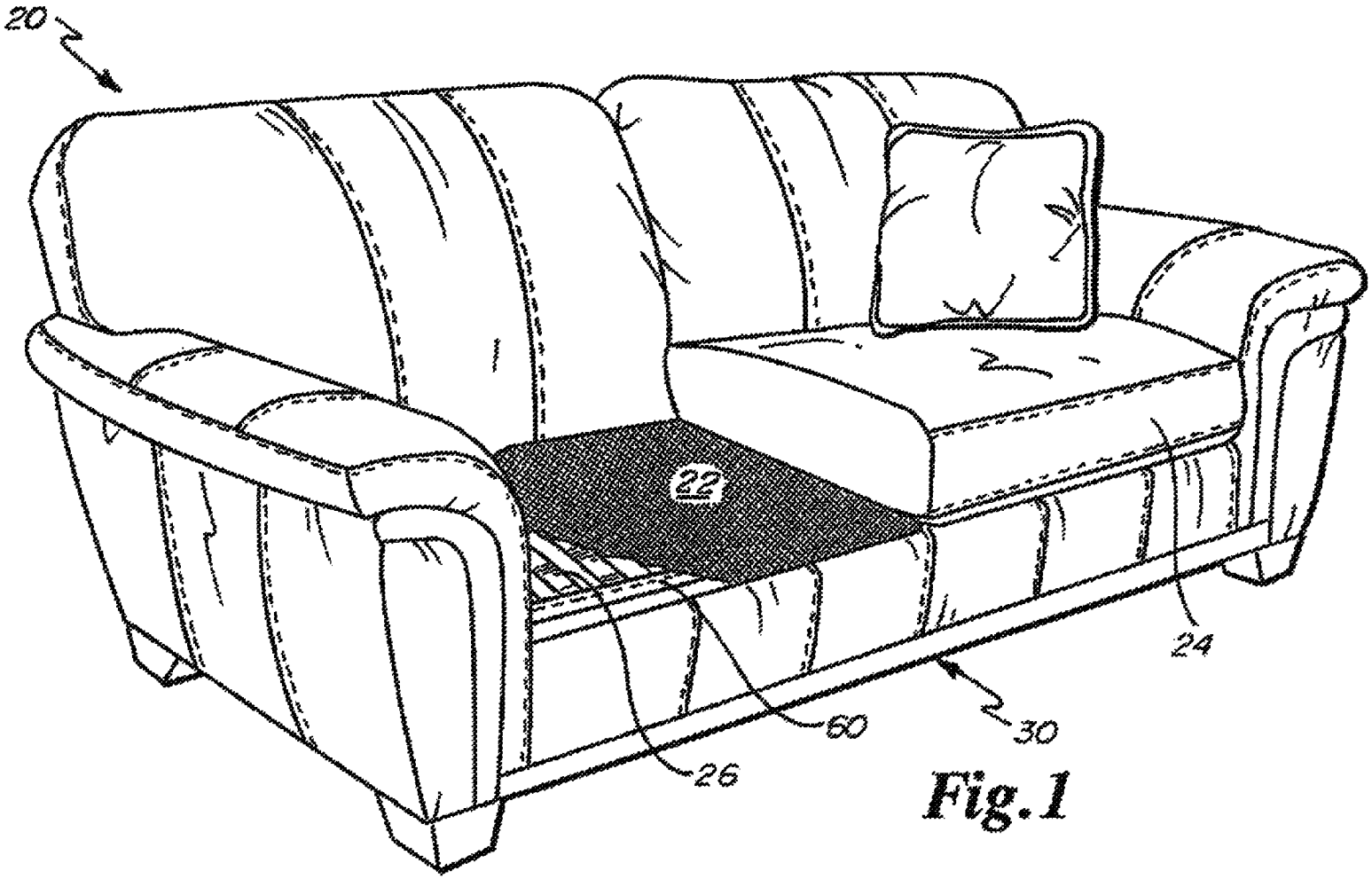
FIG. 1 is a perspective, partial cutaway view of a furniture assembly in an embodiment of the disclosure.
Figure 2A:
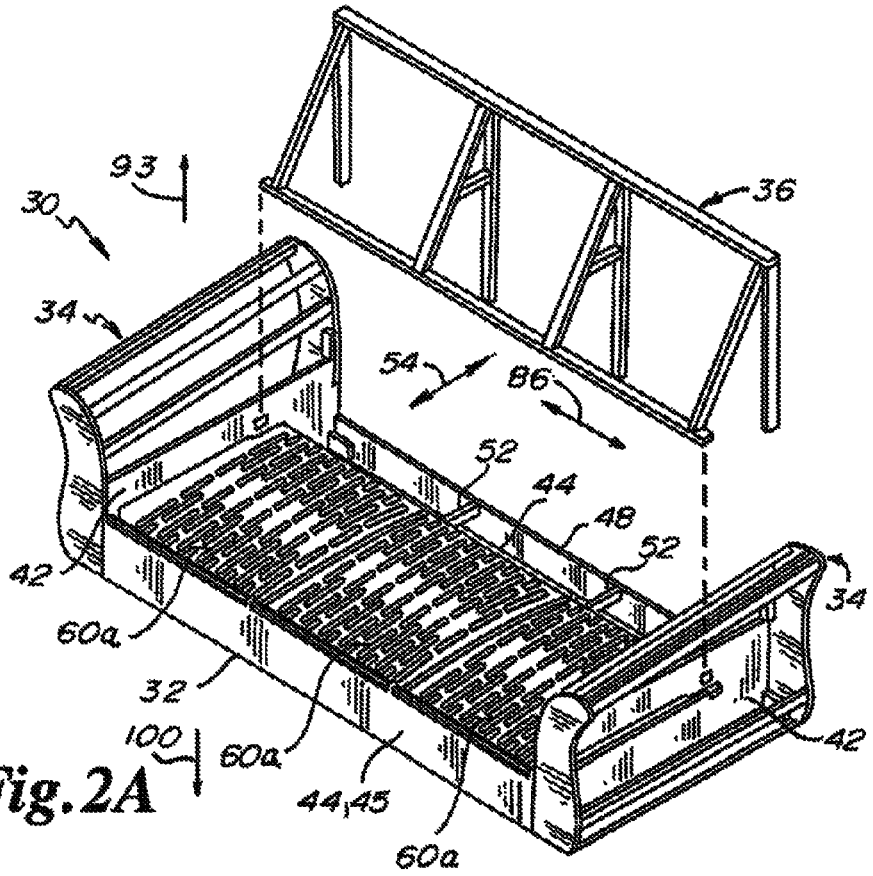
FIG. 2A is a partially exploded perspective view of a sofa framework in an embodiment of the disclosure.
Figure 2B:
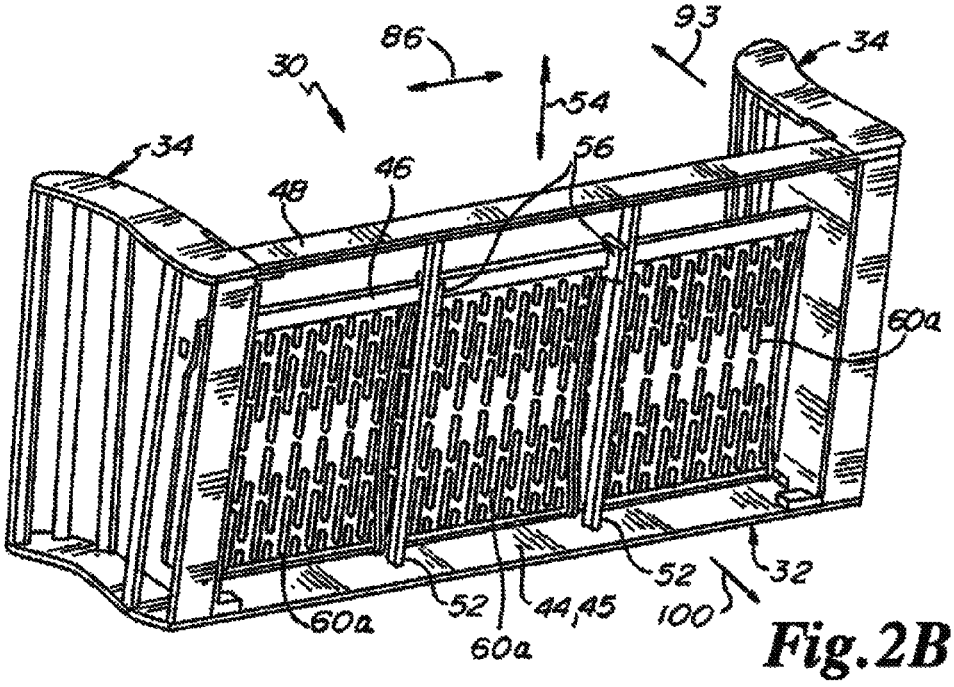
FIG. 2B is a bottom rear perspective view of the sofa framework of FIG. 2A (sans a backrest frame) in an embodiment of the disclosure.
Figure 3:
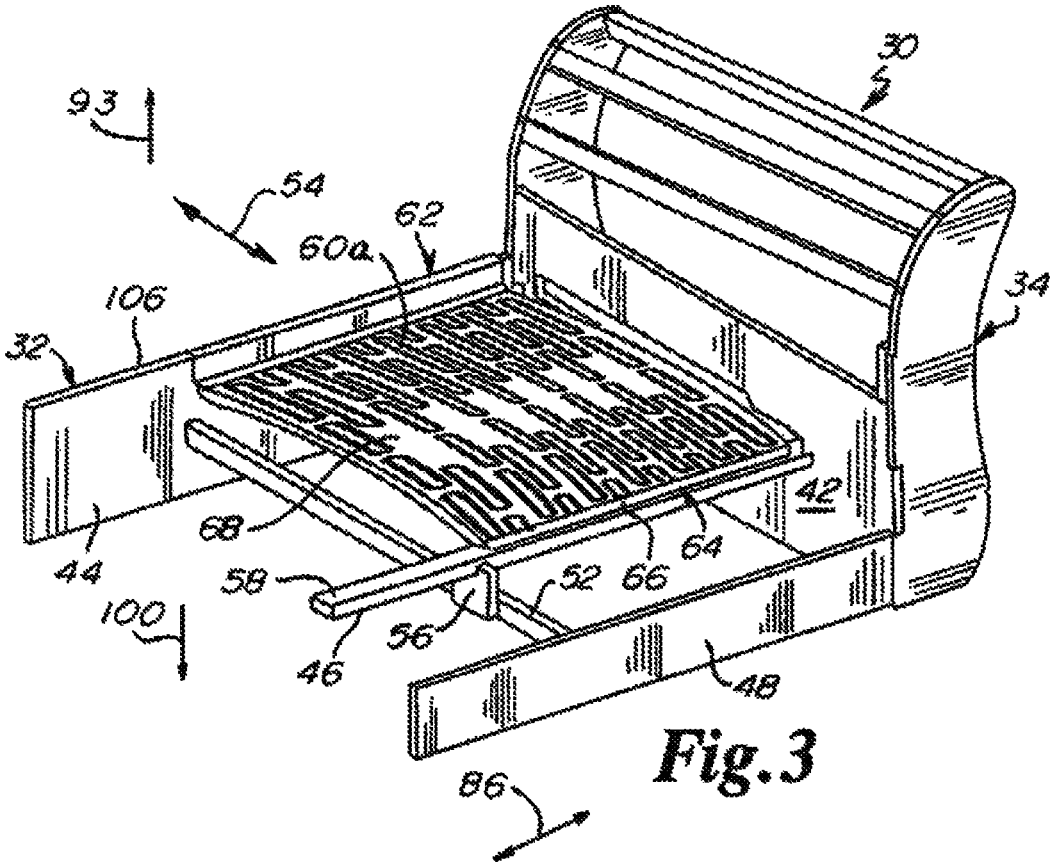
FIG. 3 is a partial rear perspective view of the sofa framework of FIG. 2A partially assembled in an embodiment of the disclosure.

Referring to FIG. 1, a furniture assembly 20 is depicted in an embodiment of the disclosure. The furniture assembly includes a framework 30 to which a drop-in seat deck 60 is mounted. The drop-in seat deck includes an arcuate seating portion 26. A stretchable cloth 22 is overlaid over the seat deck 60, upon which cushions 24 can be placed.

Referring to FIGS. 2A through 8, the framework 30 is depicted in an embodiment of the disclosure. The framework 30 includes a seating frame 32, arm rest frames 34, and a back rest frame 36. The seating frame 32 includes side members or lateral support portions 42, a forward support member 44 and a rearward support member 46. The members 42, 44, and 46, when assembled, define a deck opening. In one embodiment, the forward support member 44 is also a forward-most component 45 of the framework 30. In the depicted embodiment, the seating frame 32 includes a rearward-most component 48 that is separate from the rearward support member 46. The seating frame 32 can include cross members 52 that extend in fore-and-aft directions 54 between the forward-most component 45 or the forward support member 44 and the rearward-most component 48. Vertical supports 56 can extend upwards from the cross members 52 for mounting of the rearward support 46 thereto. Also, the arm rest frames 34 can include the side members 42 as integral components (as depicted) or can be separate structures that are attached to the side members 42. The rearward support member 46 can be substantially parallel to the forward support member 44 and include an upward-facing registration surface 58.

One or more seat decks 60*a* are operatively coupled to the forward and rearward support members 44 and 46. (Herein, various configurations for the seat deck are presented, and are referred to generically or collectively as seat deck(s) 60, and specifically as seat deck(s) 60*a* through 60*d*.) Each seat deck 60*a* includes a forward edge structure 62 and a rearward edge structure 64*a*. In the seat deck 60*a* embodiment, the forward edge structure 62 is fixedly attached to the forward support member 44, and the rearward edge structure 64*a* is registered on the upward-facing registration surface 58 of the rearward support member 46, the rearward edge structure 64*a* being a free end 66 that is translatable on the upward-facing registration surface 58. In one embodiment, each seat deck 60*a* includes a spanning portion 68 that bridges the forward edge structure 62 and the rearward edge structure 64*a*.

In an alternative embodiment (not depicted), the rearward edge structure 64*a* can be fixed to the rearward support member 46, and the forward support member 44 configured with a registration surface with the forward edge structure 62 being the free end and translatable thereon.

In one embodiment, the spanning portion 68 comprises a sheet-like structure 72 that presents an upper surface 74 and a lower surface 76. The spanning portion 68 can further include a plurality of rib portions 78 that extend lengthwise in the fore-and-aft directions 54, extending from and connecting the forward edge structure 62 and the rearward edge structure 64*a*. The stiffness imparted to the drop-in seat deck 60*a* by the rib portions 78 is established primarily by a perpendicular dimension 82 of the rib portions 78 that extends perpendicular to the surfaces of the sheet-like structure 72 of the spanning portion 68, and secondarily by a lateral dimension 84 of the rib portions 78 in lateral direction 86 (i.e., a direction perpendicular to the fore-and-aft directions 54 and substantially horizontal).

Figure 14:
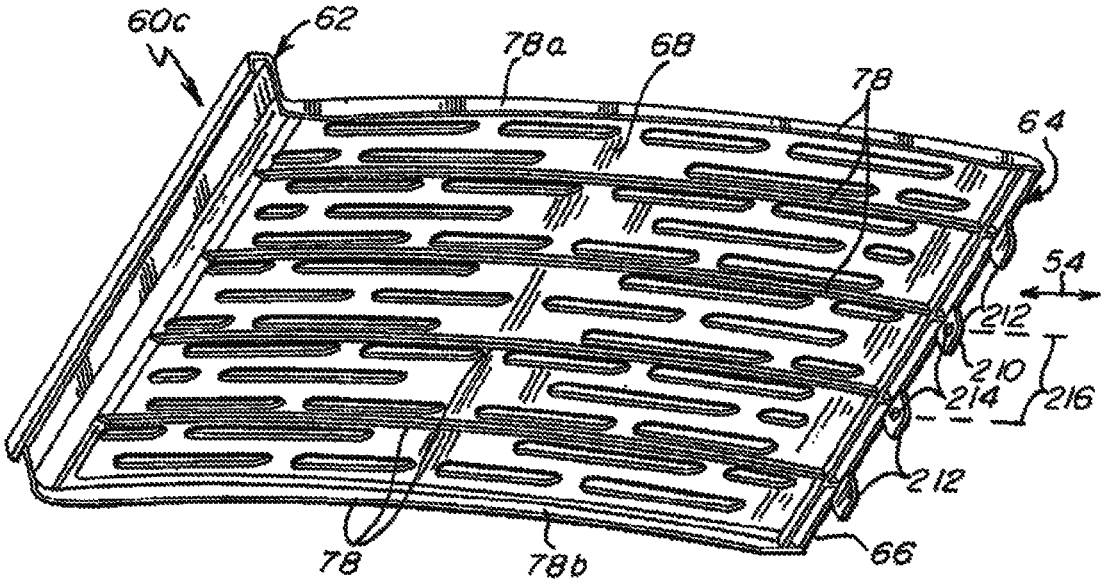
FIG. 14 is a bottom rear perspective view of the seat deck of FIG. 13 in an embodiment of the disclosure.

Each of the plurality of rib portions 78 includes an arcuate edge 88 that is integral with the sheet-like structure 72 spanning portion 68, the arcuate edge 88 causing the spanning portion 68 to conform to a convex arcuate contour 92 that is convex in an upward direction 93 and defines a local maxima 94 between the forward edge structure 62 and the rearward edge structure 64*a*. The convex arcuate contour 92 can be characterized as having a "bowed dimension" 96, defined as the distance between the upper surface 74 of the spanning portion 68 at the local maxima 94 and a baseline plane 98 that is inclusive of the lower-most points of the forward edge structure 62 and the rearward edge structure 64*a* of the seat deck 60. In one embodiment, the plurality of rib portions 78 extend in a downward direction 100 from the sheet-like structure 72 of the spanning portion 68. In one embodiment, the plurality of rib portions 78 comprise two rib portions 78*a* and 78*b*, each extending substantially perpendicular to opposing lateral edges 102 of the spanning portion 68. Some embodiments include additional rib portions 78 disposed between the opposing lateral edges 102 (FIG. 14). In one embodiment, the additional rib portions 78 disposed between the opposing lateral edges 102 can be of a different dimension than rib portions 78*a* and 78*b*.

Figure 6:
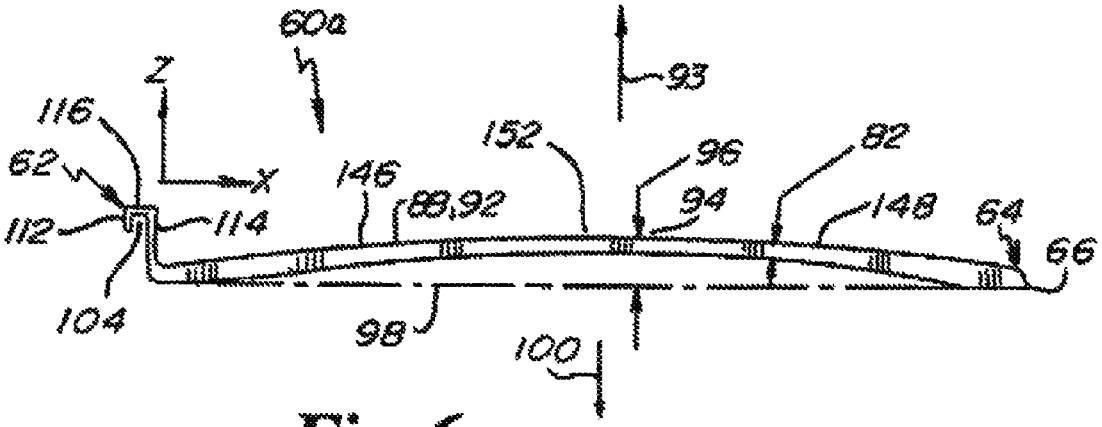
FIG. 6 is a side elevation view the seat deck of FIG. 4.
Figure 8:
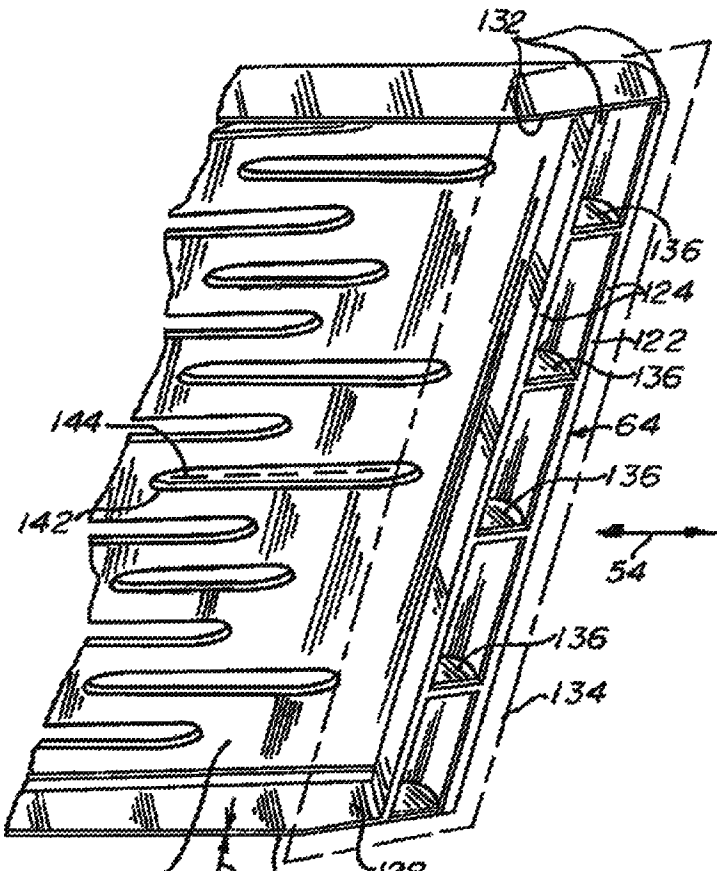
FIG. 8 is a partial front bottom perspective view of the seat deck of FIG. 4, presenting a rearward edge structure in an embodiment of the disclosure.
Figure 7:
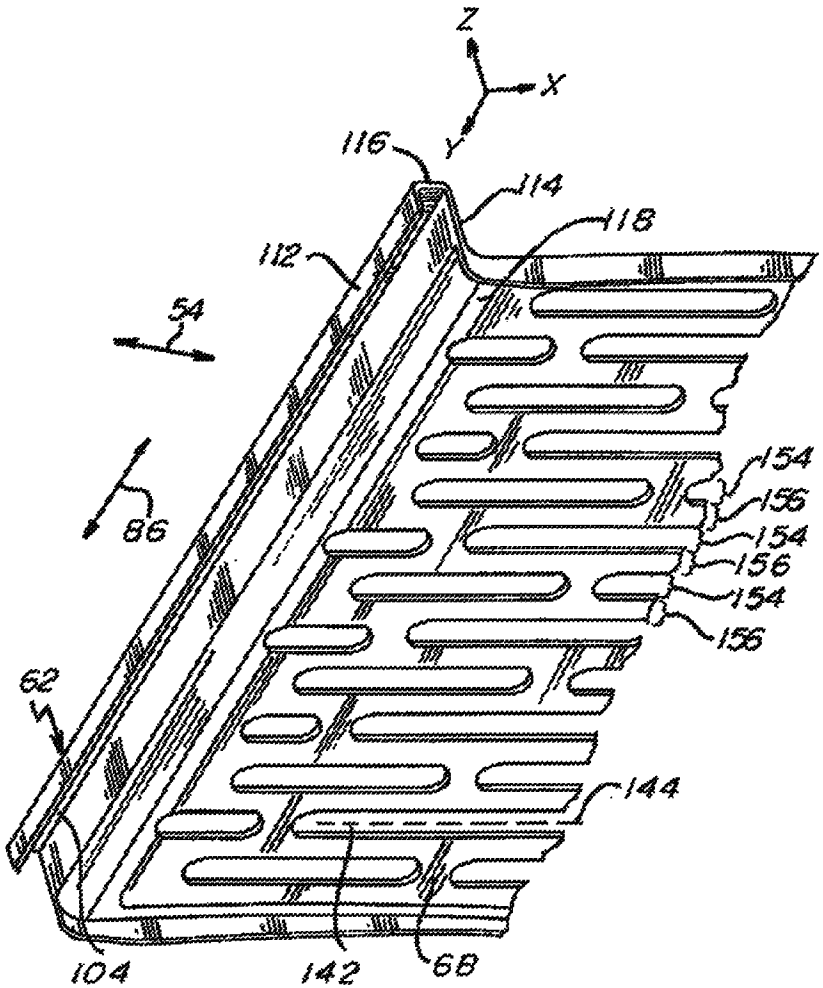
FIG. 7 is a partial front bottom perspective view of the seat deck of FIG. 4, presenting a forward edge structure in an embodiment of the disclosure.

In some embodiments, the forward edge structure 62 defines a channel 104 dimensioned to engage an upper edge 106 of the forward support member 44 (FIGS. 6 and 7). The channel 104 extends generally parallel to the forward support member 44 (i.e., substantially horizontally and in the lateral directions 86, perpendicular to the fore-and-aft directions 54) and includes flange portions 112 and 114 connected by a web portion 116, thereby defining an inverted "U" shape that engages the upper edge 106 of the forward support member 44. One of the flange portions (flange 114 in FIGS. 6 and 7) extends in the downward direction 100 to a front portion 118 of the spanning portion 68 and the plurality of rib portions 78, such that the front portion 118 of the spanning portion 68 is suspended from the forward support member 44.

In various embodiments, the rearward edge structure 64*a* also defines a channel structure 122 that can extend substantially horizontally and in the lateral directions 86 perpendicular to the fore-and-aft directions 54. In some embodiments, lower edges 124 of the channel structure 122, as well as lower edges 126 of rearward portions 128 of the plurality of rib portions 78, define bearing surfaces 132 that lie substantially on a plane 134 for engaging the upward-facing registration surface 58 of the rearward support member 46. In one embodiment, the plane 134 of the bearing surfaces 132 is coincident with the baseline plane 98. The rearward edge structure 64*a* of the seat deck 60*a* can also include gussets 136 that span the channel structure 122 to provide strength and rigidity.

In one embodiment, the spanning portion 68 defines a plurality of through-apertures 142. The through-apertures 142 collectively define an open area of the spanning portion 68. The open area can vary along the fore-and-aft directions 54 of the seat deck. Each of the through-apertures 142 can be elongated along a respective major axis 144. The major axes 144 can extend substantially parallel to the fore-and-aft directions 54. In one embodiment, the open area of the spanning portion 68 is greater at a quarter span location 146 and a three-quarter span location 148 along the fore-and-aft directions 54 than at a mid-span location 152 along the fore-and-aft directions 54.

In various embodiments, the through-apertures 142 are arranged in rows 154, thereby effectively defining elongate slat portions 156 that extend in the fore-and-aft directions 54 between the rows 154 of through-apertures 142. A given row 154 of through-apertures 142 can comprise two or more of the plurality of through-apertures 142, thereby defining one or more web portions 158 that extend between the elongate slat portions 156.

Functionally, the rows 154 of through-apertures 142 provide each of the plurality of slat portions 156 defined therebetween a degree of autonomous flexibility. A local force exerted on a given slat portion 156 primarily deflects the given slat portion 156 to a substantially greater degree than the neighboring slat portions. The web portions 158, while transferring some of the local force to the neighboring slat portions and causing some secondary deflection thereof, provides lateral stability of the slat portions 156, so that the slat portions 156 do not become widely separated in the lateral directions 86 by concentrated forces that are exerted on the seat deck 60*a* (e.g., by persons standing on cushions mounted on the seat deck).

The distribution of the open area along the fore-and-aft directions 54 of the seat deck 60*a* can also influence the shape of the seat deck 60*a* under load, selectively providing support and a higher degree of rigidity to the portion of the seat deck anticipated to receive the greatest load.

In operation, when an occupant is seated on the framework 30, most or all of the occupant's weight is transferred to the seat deck 60*a*. The weight of the occupant reduces the bowed dimension 96 of the convex arcuate contour 92, causing the free end 66 of the seat deck 60*a* to slide on the upward-facing registration surface 58 of the rearward support member 46 substantially parallel to the fore-and-aft directions 54.

Referring to FIGS. 9A through 9E, a series of curves 160 depicting profiles 162 of the upper surface 74 of the spanning portion 68 under various weight loads W1 through W4 are presented in an embodiment of the disclosure. Herein, the profiles are referred to individually as profiles 162*a* through 162*e* and collectively as profiles 162, and the weight loads W1 through W4 are referred to collectively or generically as weight loads W.

Figures 9A, 9B, 9C, 9D, 9E:
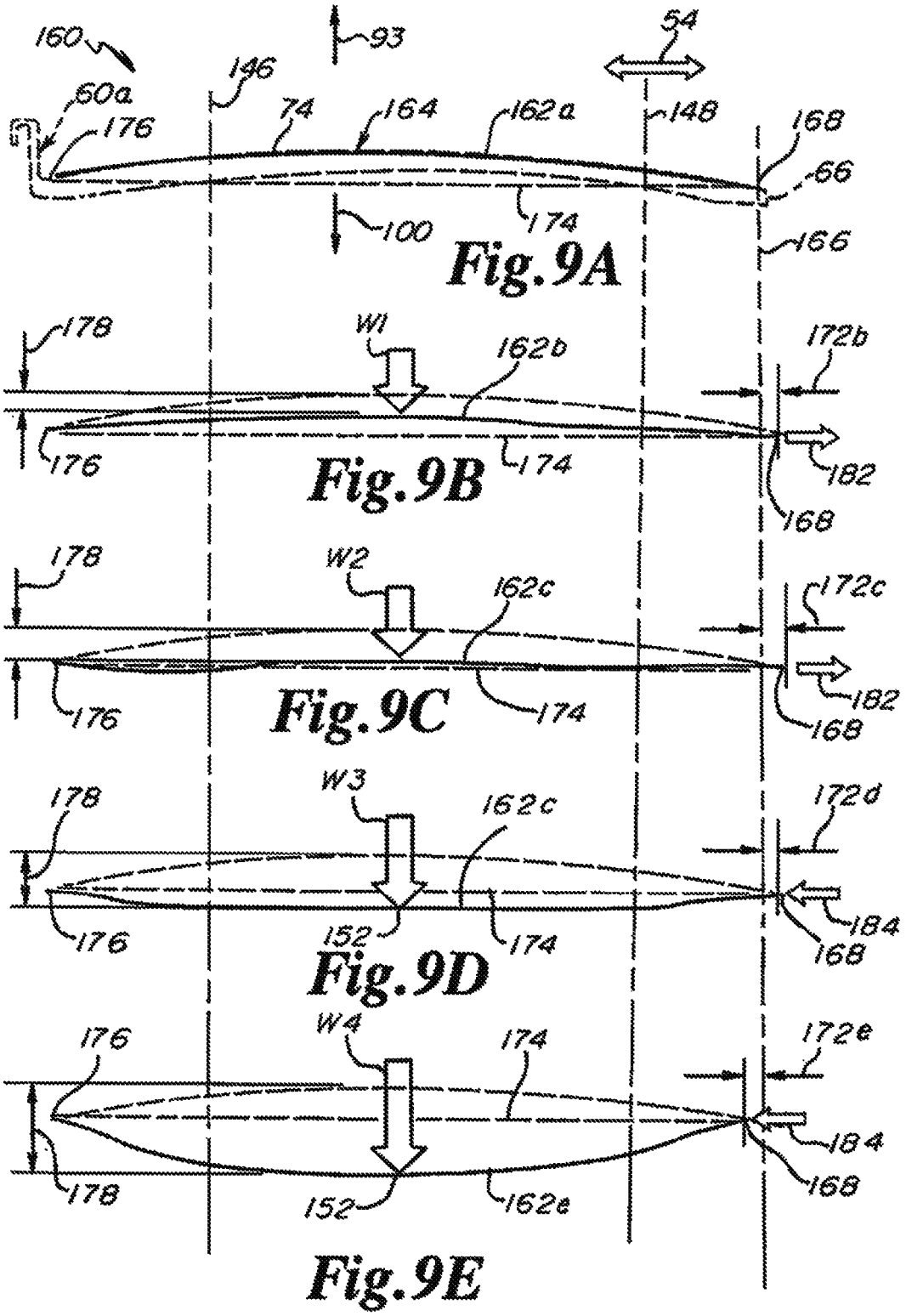
FIGS. 9A through 9E are side elevation views of a profile of an upper surface of a seat deck for various forces exerted thereon in an embodiment of the disclosure.

A profile 162*a* for the seat deck 60*a* in a free standing configuration 164 (e.g., without an occupant seated on the framework 30) is depicted in FIG. 9A, with a side elevation view of the seat deck 60*a* depicted in phantom. A datum line 166 proximate the free end 66 of the seat deck 60*a* runs through the FIGS. 9A through 9E. The datum line 166 is representative of where a rearward point 168 of the profile in the free standing configuration 164 is located to illustrate a substantially horizontal deflection 172 of the rearward point 168 of the profile relative thereto at each of the various weight loads W. (The substantially horizontal deflections 172 are referred to collectively and generically by numerical reference 172 and individually by numerical references 172*b* through 172*e*.) The quarter span locations 146 and 148 also run through the FIGS. 9A through 9E. In addition, a reference plane 174 that passes through a forward point 176 and the rearward point 168 of the profiles 162 is depicted in each of FIGS. 9A through 9E. The FIGS. 9B through 9E also include the profile 162*a* of the free standing configuration 164 in dashed line to illustrate a vertical deflection 178 of the upper surface 74 of the spanning portion 78 relative thereto at each of the various weight loads W.

Initially, for increasing weight loads W1 and W2, the profiles 162*b* and 162*c* of the upper surface 74 flattens out and approaches the reference plane 174. The flattening of the profiles 162*b* and 162*c* causes the free end 66 of the seat deck 60*a*, and therefore the rearward point 168 of the profiles 162*b* and 162*c*, to extend in a rearward direction 182, thereby causing the substantially horizontal deflection 172 to increase as the vertical deflection 178 increases (FIGS. 9B and 9C). The magnitude of the substantially horizontal deflections 172 corresponds generally to the magnitude of the deflection of the free end 66 of the seat deck 60. As the profile substantially reaches the reference plane 174, the rearward translation of the free end 66 of the seat deck 60*a* reaches a maximum, thereby defining a maximum horizontal deflection 172*c* of the rearward point 168 of the profile 162*c* (FIG. 9C).

For some embodiments, as the weight loads W continue to increase to weight load W3 and then to weight load W4, the profile 162 undergoes an inversion, wherein the upper surface 74 defines a generally concave profile 162*d*, 162*e* (FIGS. 9D and 9E). As the profile passes substantially through the reference plane 174, the translation of the free end 66 of the seat deck 60*a* reverses and translates a forward direction 184, so that the substantially horizontal deflection 172*d* diminishes relative to the substantially horizontal deflections 172*b* and 172*c* as the vertical deflection 178 continues to increase (FIG. 9D). As the weight load W continues to increase from W3 to W4, the substantially horizontal deflection 172 can continue to migrate in the forward direction 184, eventually crossing over the datum line 166 of the free standing configuration 164 to define a substantially horizontal deflection 172*e* that is forward of the datum line 166.

In some embodiments, the shape of the profile 162 under load can be influenced by the variation of the stiffness of the seat deck 60*a* along the fore-and-aft directions 54. For example, in one embodiment, the stiffness of the seat deck 60*a* proximate the quarter span location 146 and the three-quarter span location 148 (quarter spans) can be reduced relative to the stiffness proximate the mid-span (half-span) location 152, thereby causing the profile 162 of the spanning portion 68 under loaded conditions to have greater inflections at the quarter spans than at other points on the profile 162.

Figure 4:
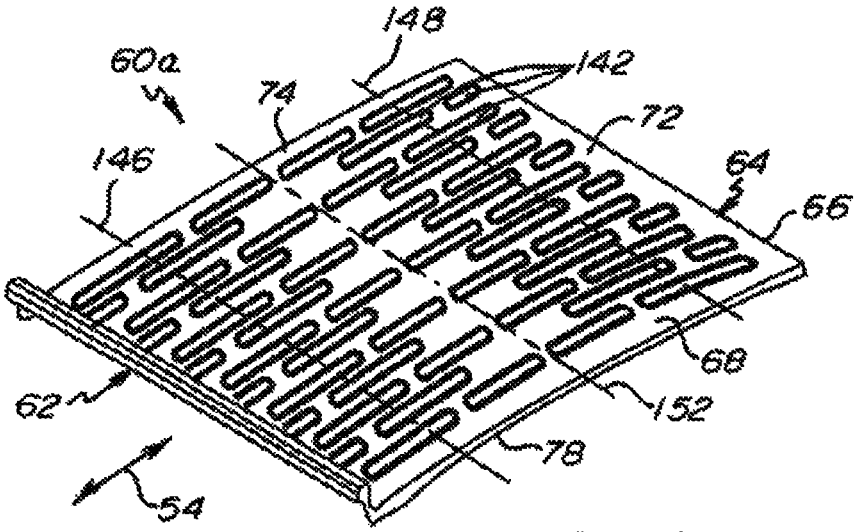
FIG. 4 is a front top perspective view of a seat deck in isolation in an embodiment of the disclosure.
Figure 5:
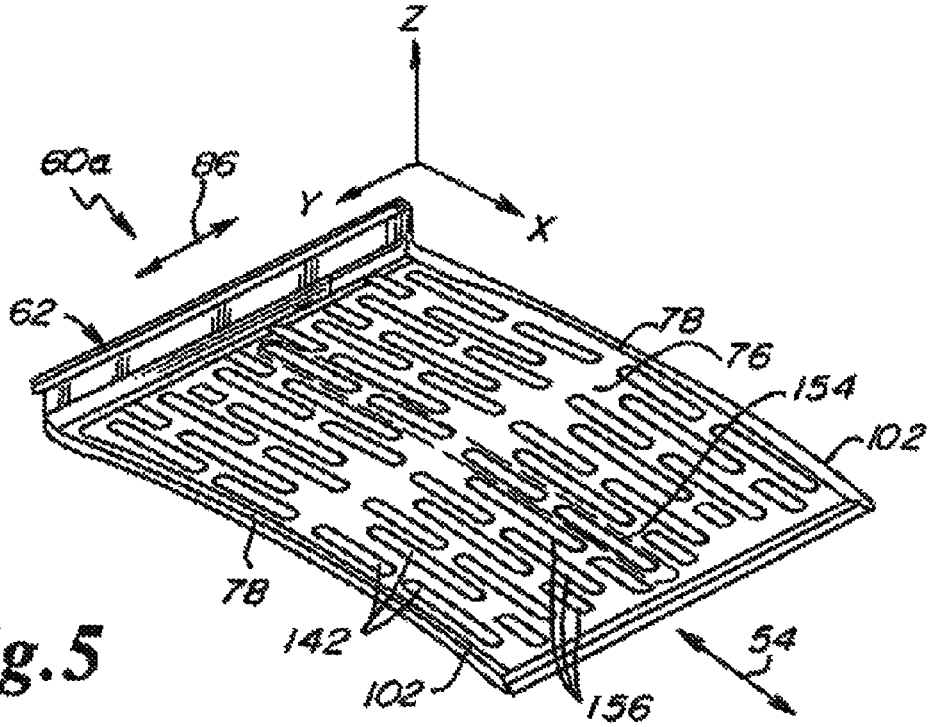
FIG. 5 is a front bottom perspective view of the seat deck of FIG. 4 in an embodiment of the disclosure.

The variation of the stiffness can be effected, for example, by varying distribution of the open area along the fore-and-aft directions 54, such as depicted and discussed at FIGS. 4 and 5. In the embodiment of FIGS. 4 and 5, there is more open area at the quarter spans 146 and 148 than at the mid-span 152, which can promote greater inflections at the quarter spans 146 and 148 and a flatter profile at the mid-span 152. In other embodiments (not depicted), the ribs can be tailored to provide varying stiffness over the fore-and-aft directions to the same effect (e.g., having a greater perpendicular dimension 82 across the mid-span 152 than at the quarter spans 146 and 148).

Functionally, the effect of the variation of stiffness as described can provide more support at the mid-span 152, thereby causing the profile 162 to be flatter at the mid-span 152 under maximum design loads (e.g., W4 of FIG. 9E) than at the quarter spans 146, 148, as also illustrated in FIGS. 9A through 9E. Accordingly, the seat deck undergoes greater inflections at locations that are distanced from the center of the load W, which can provide less inflection immediately below the occupant and greater comfort to the occupant. The tailored deflection profile 162 can also reduce the overall magnitude of the vertical deflection 178. For injection molded components, the open area can also reduce the amount of material required to fabricate the seat deck 60.

Figure 10:
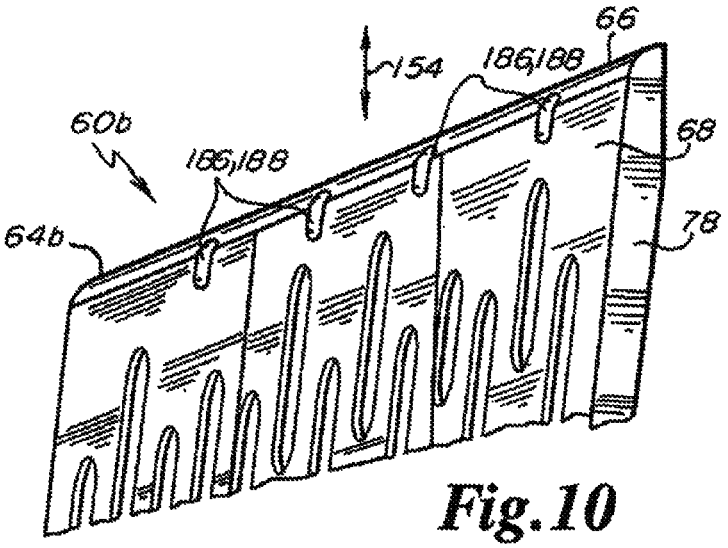
FIG. 10 is partial top perspective view of a rearward edge structure of a seat deck in an embodiment of the disclosure.
Figure 11:
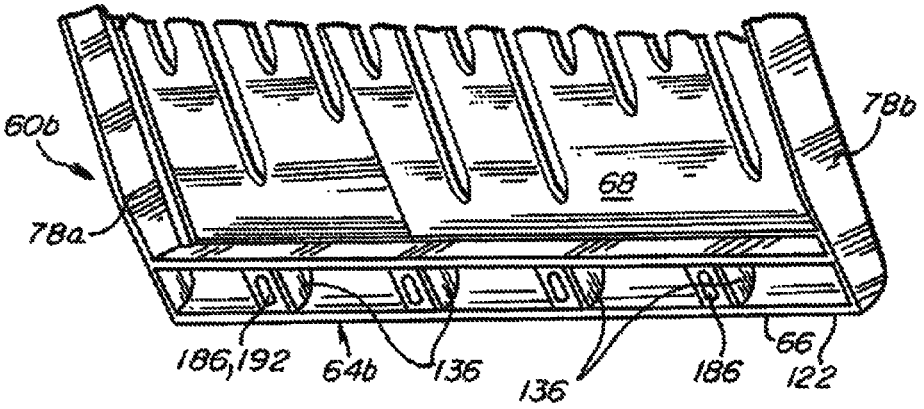
FIG. 11 is partial bottom perspective view of the rearward edge structure of the seat deck of FIG. 10 in an embodiment of the disclosure.
Figure 12:
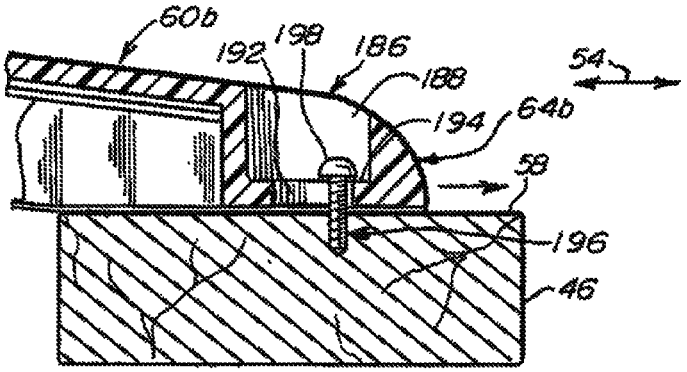
FIG. 12 is a partial sectional view of the rearward edge structure of the seat deck of FIG. 10 installed on a rearward support in an embodiment of the disclosure.

Referring to FIGS. 10 through 12, details of a rearward edge structure 64*b* for a seat deck 60*b* is depicted in an embodiment of the disclosure. The rearward edge structure 64*b* includes many of the same aspects as the rearward edge structure 64*a*, which are identified with same-numbered numerical references. In addition, the rearward edge structure 64*b* defines elongated slot structures 186 that are formed in one or more of the gussets 136. Each of the elongated slot structures 186 can be elongated in the fore-and-aft directions 54 and include an access opening 188 and a through-opening 192, thereby defining a shoulder 194 that surrounds the through-opening 192 of the elongated slot structure 186.

In assembly, a fastener 196 with a head portion 198, can be routed through one or more of the elongated slot structures 186 of the gussets 136 and affixed to the rearward support member 46. In this embodiment, the head portion 198 is oversized relative to a lateral dimension 202 of the through-opening 192 of the elongated slot structure 186, and the fastener 196 can be affixed to the rearward support member 46 so that the head portion 198 of the fastener 196 is adjacent to but not in contact with the shoulder 194 of the elongated slot structure 186.

In operation, the elongate orientation of the through-opening 192 and the non-contact or sliding contact between the head portion 198 of the fastener 196 and the shoulder 194 of the elongated slot structure 186 enables the rearward edge structure 64*b* to translate in the fore-and-aft directions 54, as described in relation to FIGS. 9A through 9E, while preventing the rearward edge structure 64*b* from lifting away from the upward-facing registration surface 58 of the rearward support member 46. The fastener 196 can also function as a stop that limits the translation of the rearward edge structure 64*b* in the fore-and-aft directions 54.

Figure 13:
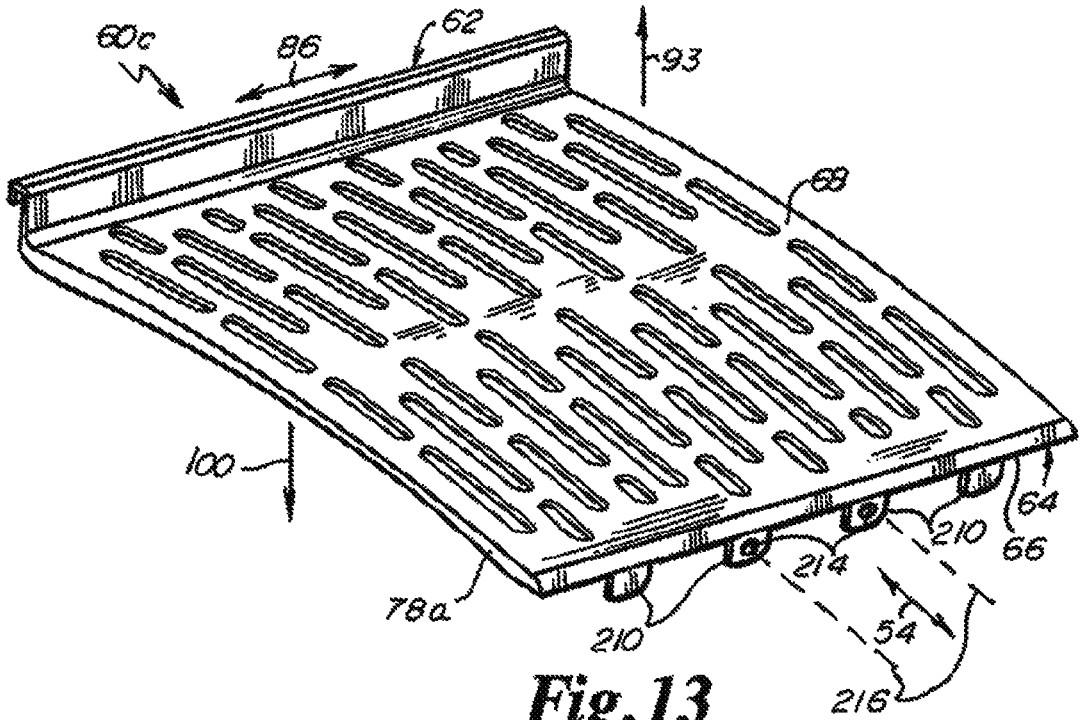
FIG. 13 is a top rear perspective view of a seat deck in an embodiment of the disclosure.

Referring to FIGS. 13 and 14, a seat deck 60*c* is depicted in an embodiment of the disclosure. The seat deck 60*c* includes many of the same aspects as the seat deck 60*a*, identified with same-numbered numerical references. The seat deck 60*c* includes a plurality of tab portions 210 that depend from the rearward edge structure 64. Each tab portion 210 includes a forward face 212. In one embodiment, some or all of the tab portions 210 can include structure defining a through-hole 214, the through hole defining a guide axis 216 that is substantially parallel to the fore-and-aft directions 54.

Figure 14A:
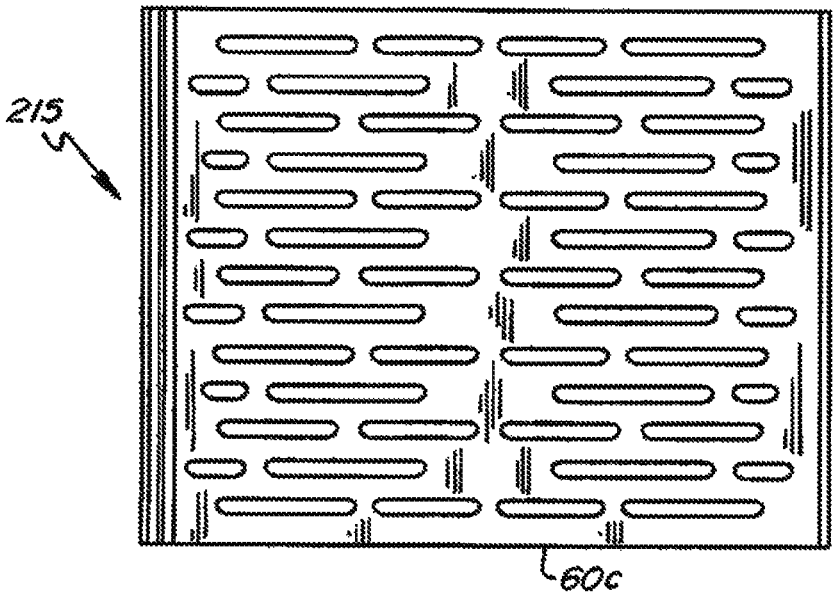
FIGS. 14A through 14C is a three-way orthographic projection of the seat deck of FIGS. 13 and 14 in an embodiment of the disclosure.
Figure 14B:
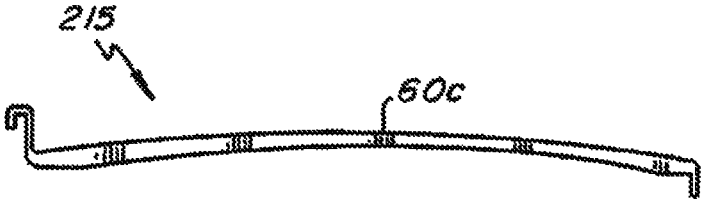
Figure 14C:
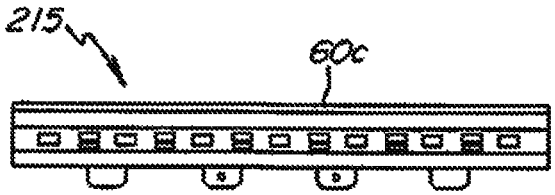

Referring to FIGS. 14A through 14C, a three-way orthographic projection 215 of the seat deck 60*c* is depicted in an embodiment of the disclosure. The thickness of the sheet-like structure 72 also contributes to the stiffness of the seat decks 60. In one embodiment, a non-limiting thickness of the sheet-like structure 72 is in the range of 1 mm to 8 mm inclusive. A non-limiting perpendicular dimension 82 of the rib portions 78 can be in the range of 4 mm to 20 mm inclusive.

Figure 15A:
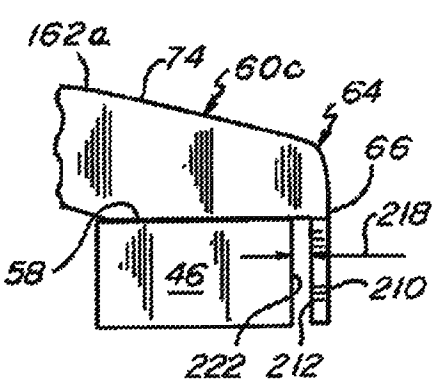
FIGS. 15A through 15C depict a rear edge structure of the seat deck of FIG. 13 during operation in an embodiment of the disclosure.
Figure 15B:
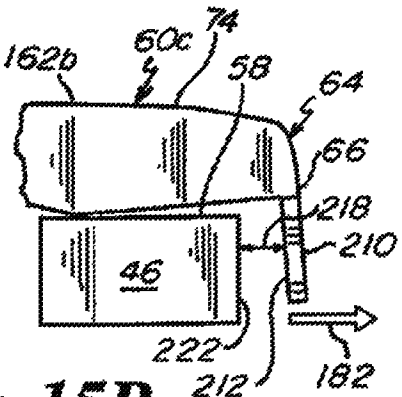
Figure 15C:
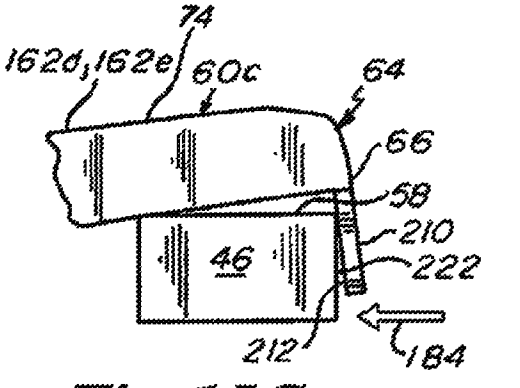

Referring to FIGS. 15A through 15C, the seat deck 60*c* is depicted in operation in an embodiment of the disclosure. In one embodiment, the rearward support member 46 is positioned to be forward of the tab portions 210 in the free standing configuration, defining a gap 218 between the forward face 212 of the tab portion 210 and a rearward face 222 of the rearward support member 46 (FIG. 15A). As the profile 162 of the upper surface 74 flattens under load (as depicted in FIGS. 9B and 9C and described in the discussion attendant thereto), the flattening of the profile 162 causes the free end 66 of the seat deck 60*c* to extend in the rearward direction 182 (FIG. 15B). The flattening of the profile 162 can cause part of the rearward edge structure 64 to rotate away from and become canted in relation to the upward-facing registration surface 58 of the rearward support member 46. Because the tab portions 210 are disposed rearward of the rearward support member 46, the translation of the free end 66 in the rearward direction 182 is uninhibited. As the profile 162 of the upper surface 74 inverts into the concave profiles 162*d*, 162*e*, the substantially horizontal deflection 172 of the free end 66 reverses (as depicted in FIGS. 9D and 9E and described in attendant thereto) and the tab portions 210 migrate toward the rearward support. If the substantially horizontal deflection 172 of the free end 66 reverses far enough, the tab portions 210 engage the rearward face 222 of the rearward support member 46 (FIG. 15C). The continued vertical deflection 178 of the spanning portion 68 can also cause the canting of the rearward edge 64 structure to become more pronounced.

Figure 16A:
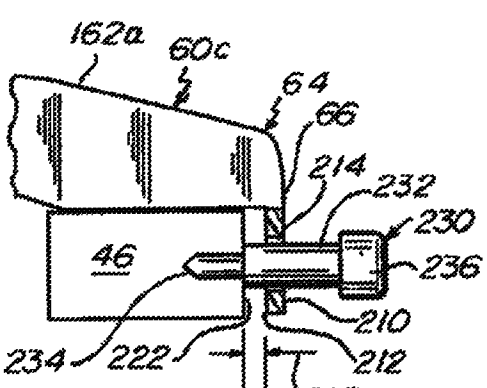
FIGS. 16A through 16C depict the rear edge structure of the seat deck of FIG. 13 with a guide installed during operation in an embodiment of the disclosure.
Figure 16B:
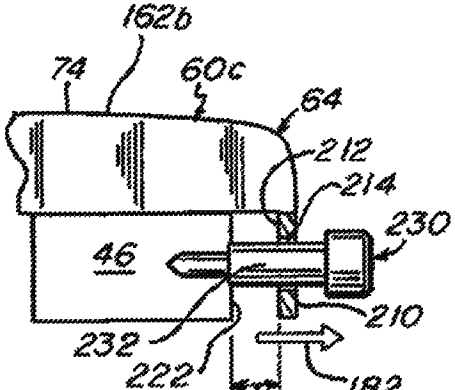
Figure 16C:
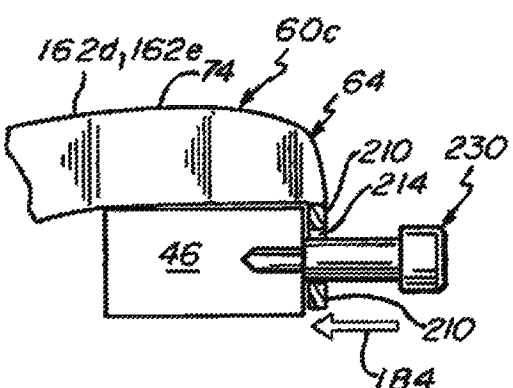
Figure 17:
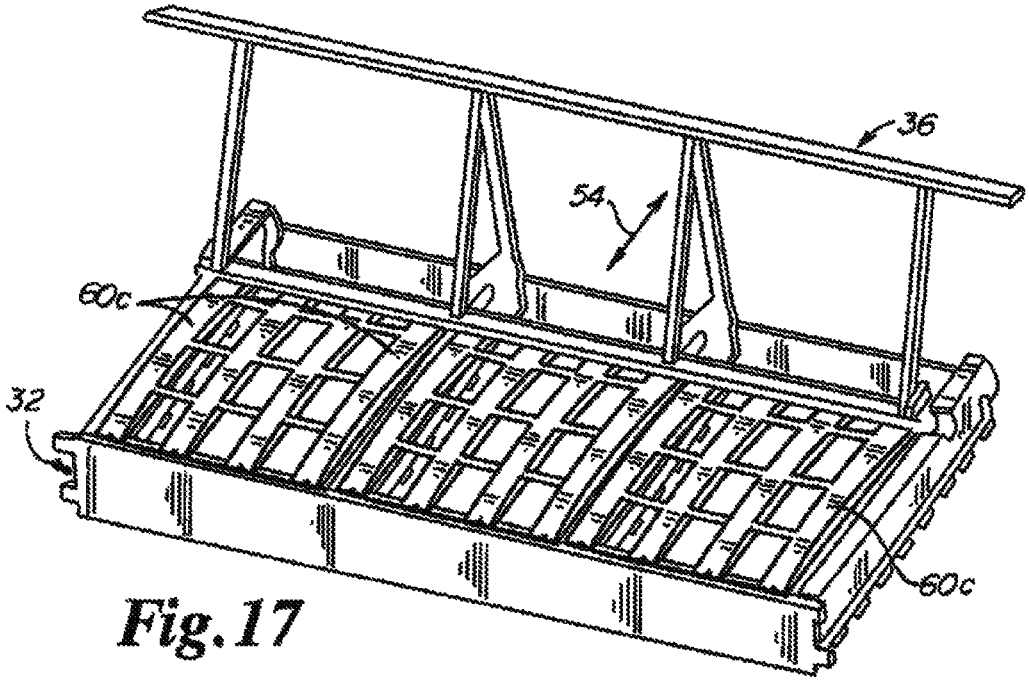
FIG. 17 is a perspective view of a partially assembled sofa framework in an embodiment of the disclosure.
Figure 18:
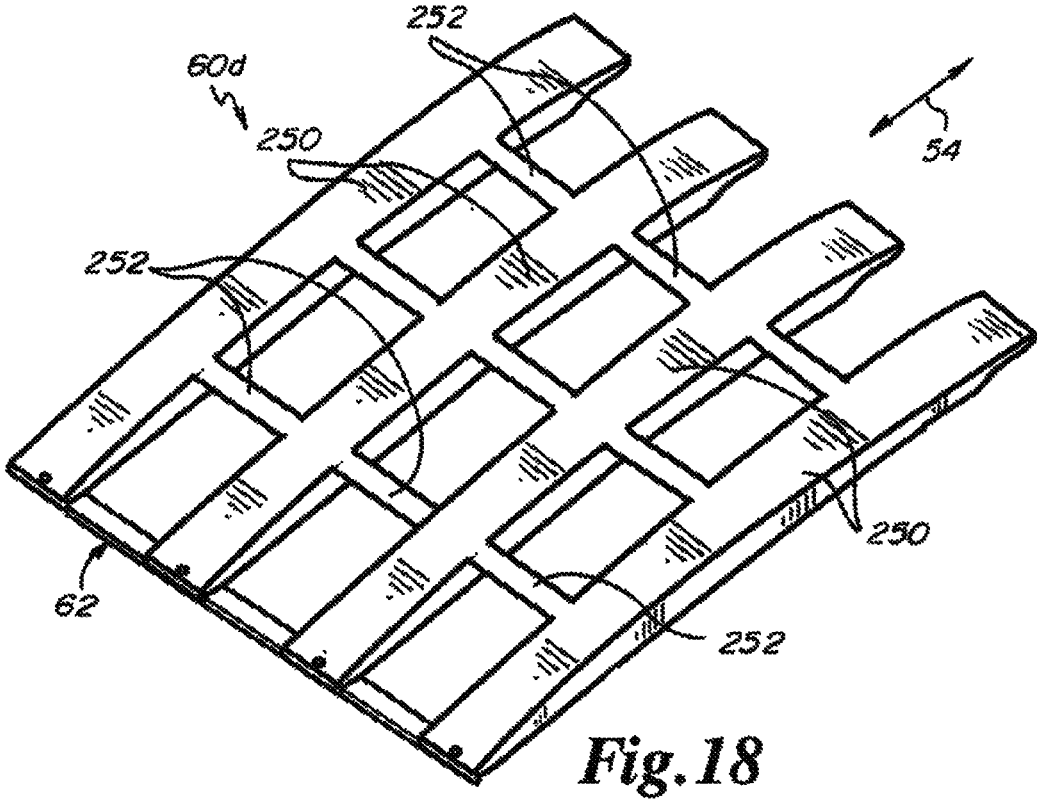
FIG. 18 is a top perspective view of a seat deck of the sofa framework of FIG. 17 in an embodiment of the disclosure.

Referring to FIGS. 16A through 16C, the seat deck 60*c* is depicted in operation in another embodiment of the disclosure. In this embodiment, the rearward support member 46 is again positioned to be forward of the tab portions 210 in the free standing configuration, defining the gap 218 between the forward faces 212 of the tab portions 210 and the rearward face 222 of the rearward support member 46 (FIG. 16A). Also in this embodiment, a guide 230 is secured to the rearward face 222 of the rearward support member 46. The guide 230 can comprise a smooth surface 232 between a threaded portion 234 and a cap portion 236, such as provided, for example, by a shoulder bolt. The guide 230 can be routed through and substantially centered within the through-hole 214 of the tab portion 210 when the seat deck 60*c* is in the free standing configuration.

As the profile 162 of the upper surface 74 flattens under load (as depicted in FIGS. 9B and 9C and described in the discussion attendant thereto), the flattening of the profile 162 causes the free end 66 of the seat deck 60*c* to extend in the rearward direction 182 (FIG. 16B). Because the tab portions 210 are disposed rearward of the rearward support member 46, the translation of the free end 66 in the rearward direction 182 is uninhibited parallel to the guide axis 216 of the through-hole 214. As the profile 162 of the upper surface 74 inverts into the concave profiles 162*d*, 162*e*, the substantially horizontal deflection 172 of the free end 66 reverses (as depicted in FIGS. 9D and 9E and described in the discussion attendant thereto) and the tab portions 210 migrate toward the rearward support 46. If the substantially horizontal deflection of the free end reverses far enough, the tab portions 210 engage the rearward face 222 of the rearward support member 46 (FIG. 16C).

Functionally, the tab portions 210 serve as a stop or catch mechanism that prevents the rearward end structure 64 of the seat deck 60*c* from sliding off the rearward support member 46 in the forward direction 184. The guide 230, when utilized as depicted in FIGS. 16A through 16C, enables the tab portions 210 to translate freely along the smooth surface 232 of the guide 230 parallel to the guide axis 216 of the through-hole 214, while resisting movement of the tab portions 210 in a direction that is orthogonal to the guide axis 216 of the through-hole 214. The guides 230 provide an added measure of security between the seat deck 60*c* and the rearward support member 46, helping to prevent the tabs from jumping over the rearward support member 46. The resistance to the orthogonal movement counters, at least in part, the canting of the rearward edge structure 64. The restriction of the rotation of the rearward edge structure 64 also enhances the rigidity of the assembly, because the deflection characteristics of the seat deck 60*c* are more akin to that of a fixed end beam than a free end beam.

Referring to FIGS. 17 through 19B, a seat deck 60*d* is depicted in an embodiment of the disclosure. The seat deck 60*d* includes some of the same aspects and attributes as the seat deck 60*a*, indicated with same numbered numerical references. The seat deck 60*d* comprises elongate slat members 250 that extend in the fore-and-aft directions 54 and are tied together with lateral tie members 252. Each elongate slat member 250 can include a plurality of rib portions 254 which, in one embodiment, extend in the downward direction 100 from an upper portion 256 of the respective elongate slat member 250. A plurality of cross-ribs 255 can also be included to provide stability for the rib portions 254. In one embodiment, each elongate slat member 250 includes a rearward edge structure 258 shaped to engage the upward-facing registration surface 58 of the rearward support member 46.

Referring to FIGS. 20 through 23, a seat deck 60*e* is depicted in an embodiment of the disclosure. The seat deck 60*e* includes some of the same aspects and attributes as the seat decks 60*a* and 60*d*, indicated with same- or like-numbered numerical references. Like seat deck 60*a*, the seat deck 60*e* includes the forward edge structure 62 defining the channel 104, and also defines a rearward edge structure 64*e*. Like the seat deck 60*d*, the seat deck 60*e* includes elongate slat members 260 that extend in the fore-and-aft directions 54 and are tied together with lateral tie members 252. In addition, the seat deck 60*e* includes flexures 270 that bridge the forward edge structure 62 and the elongate slat members 260, the flexures 270 being configured to flex in the fore-and-aft directions 54.

In the seat deck 60*e* embodiment, the elongate slat members 260 define a semi-circular cross-section 262 normal to the fore-and-aft directions 54. The semi-circular cross-sections 262 are arranged so that a convex face 264 thereof is centered in the upward direction 93. The semi-circular geometry provides stiffness in the downward direction 100. While not depicted, the elongate slat members 260 can include ribs akin to the rib portions 254 of elongate slat members 250 (FIGS. 19A and 19B) to provided additional stiffness. In some embodiments, gussets 266 are included that span the interior of the semi-circular cross-sections 262 in the lateral directions 86. The gussets 266 provide dimensional stability of the cross-sections 262. Other cross-sections are contemplated, such as a semi-rectangular channel shape (akin to slat members 250), semi-elliptical, semi-polygonal, and angle, and as well as closed-form cross-sections such as rectangular, circular, elliptical, triangular, polygonal, flat bar, and rods. (Herein, any "semi" shape defines an open cross-section normal to the fore-and-aft directions 54.)

For the seat deck 60*e*, the flexures 270 are "S-shaped" flexures 272, referring to the shape as viewed from the side, as best seen in FIGS. 22 and 23. The S-shaped flexures 272 are configured to compress and elongate in the fore-and-aft directions 54. Specifically, the S-shaped flexure 272 includes a first bend 274 that depends from the forward edge structure 62 and is convex in the downward direction 100. The first bend 274 can be characterized as defining a first minimum bend radius R1, a first node 275 and a first flexure axis 273. The first flexure axis 273 passes through the first node 275 and defines the axis about which the first bend 274 flexes or rotates when a compression or tension force is applied to the S-shaped flexure 272.

Also in the depicted embodiment of FIGS. 20 through 23A, a second bend 278 extends upward from the first bend 274 and is convex in the upward direction 93. A respective one of the elongate slat members 260 extends in the fore-and-aft direction 54 from the second bend 278. The second bend 278 can be characterized as defining a second minimum bend radius R2, a second node 279, and a second flexure axis 277. The second flexure axis 277 passes through the second node 279 and defines the axis about which the second bend 278 flexes or rotates when a compression or tension force is applied to the S-shaped flexure 272. In the depicted embodiment of FIGS. 20 through 23A, the flexure axes 273 and 277 are substantially parallel to the lateral directions 86.

Figure 20:
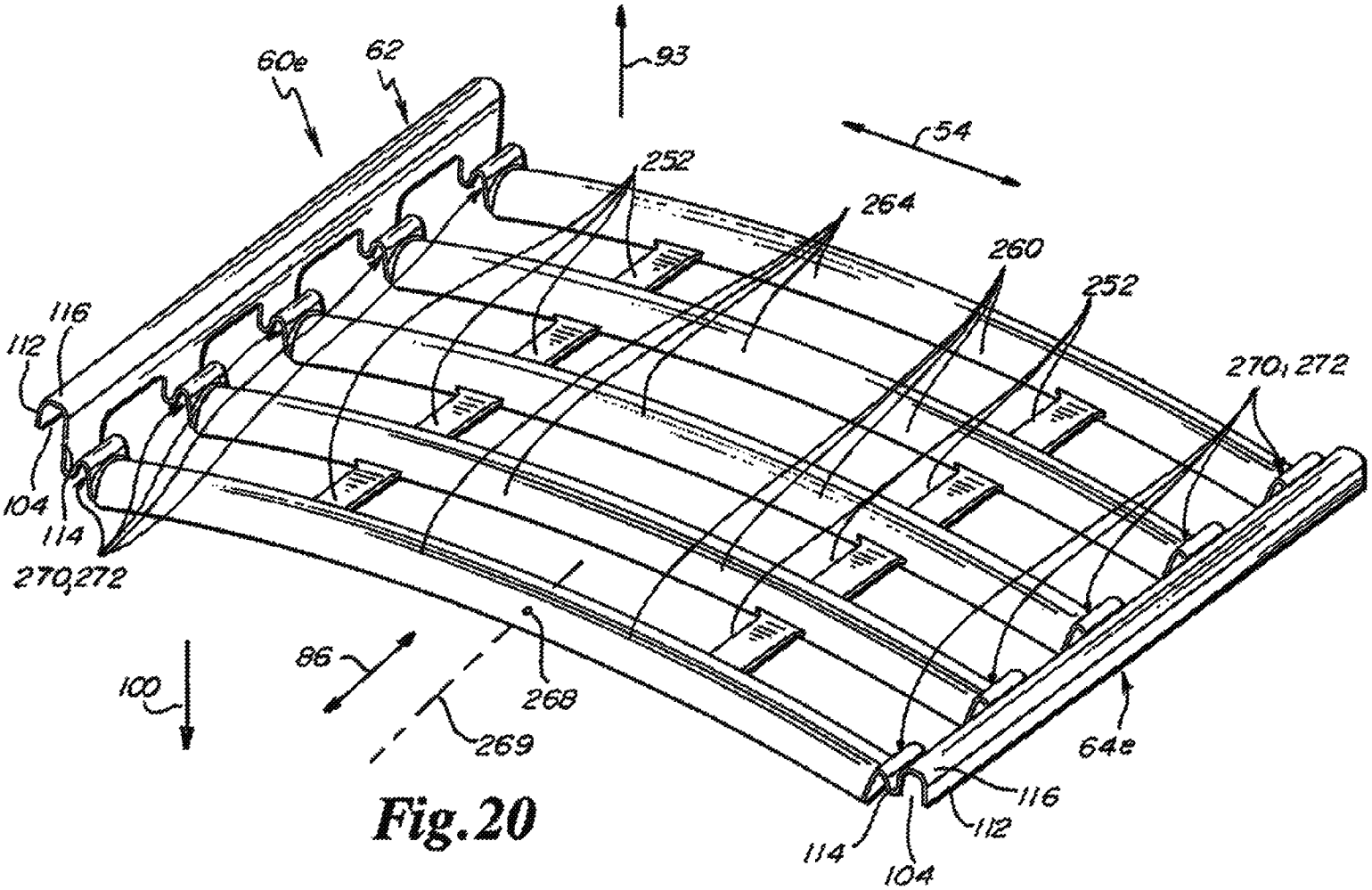
FIG. 20 is a top perspective view of a seat deck in an embodiment of the disclosure.
Figure 21:
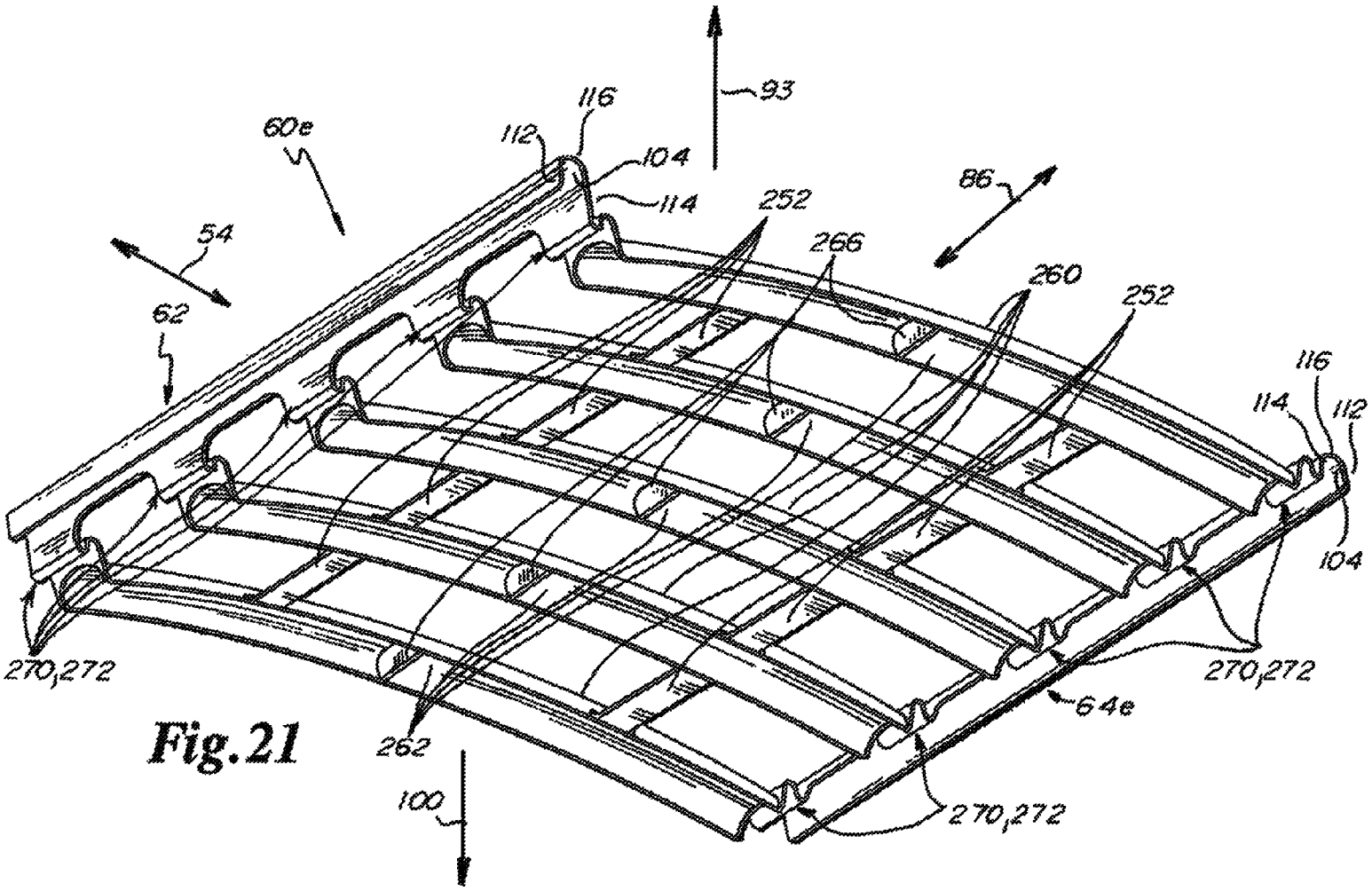
FIG. 21 is a bottom perspective view of the seat deck of FIG. 20 in an embodiment of the disclosure.

It is further noted that each of the elongate slat members 250, 260 can be characterized as defining a node 268 and a flexure axis 269 about the node 268, as depicted, for example, in FIG. 20, and also presented in FIGS. 25, 29, and 30. That is, the elongate slats 250, 260 can be characterized as flexing substantially about the node 268 and about the flexure axis 269. In the depicted embodiments, the flexure axis 269 is substantially parallel to the lateral directions 86. In various embodiments, the location of the node 268 and flexure axis 269 is at the mid-span of the elongate slat member 250, 260.

The rearward edge structure 64*e* of the seat deck 60*e* also includes structure akin to the channel 104, again with flexures 270 such as the S-shaped flexures 272 bridging the rearward edge structure 64*e* and the elongate slat members 260. In some embodiments, the channel 104 of the forward edge structure 62 extends further in the upward direction 93 than does the channel 104 of the rearward edge structure 64*e*, which enables a forward face of a seat cushion (not depicted) to settle into the framework 30 to eliminate unsightly gaps between the cushion and the framework 30.

Referring to FIG. 24, installation of the seat deck 60*e* onto a seating frame 32*e* is depicted in an embodiment of the disclosure. The seating frame 32*e* has many of the same aspects and attributes as the seating frame 32, which are identified with same-numbered numerical references. In the FIG. 24 depiction, the rearward support member 46 is configured or oriented within the vertical supports 56 so as to present an upper edge 276, akin to the upper edge 106 of the forward support member 44. In assembly, the seat deck 60*e* is disposed on the seating frame 32*e* so that the forward edge structure 62 captures the upper edge 106 of the forward support member 44 and the rearward edge structure 64*e* captures the upper edge 276 of the rearward support member 46. In various embodiments, the forward and rearward edge structures 62 and 64*e* are secured to the respective support members 44 and 46*e*, for example with fasteners such as with staples, screws, or nails. Accordingly, unlike the seat decks 60*a*-60*d* which enable the rearward edges 64 to translate freely on the rearward support 46, the rearward edge structure 64*e* of the seat deck 60*e* is in fixed relation to the rearward support 46*e*.

Figure 19:
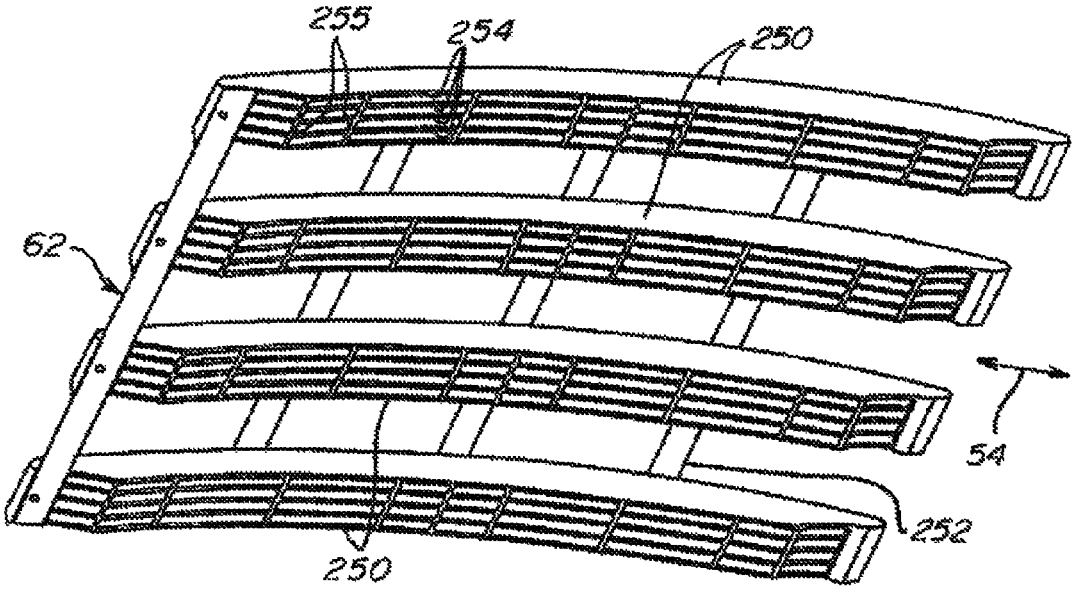
FIG. 19 is a bottom perspective view of the seat deck of the sofa framework of FIG. 17 in an embodiment of the disclosure.
Figure 19A:
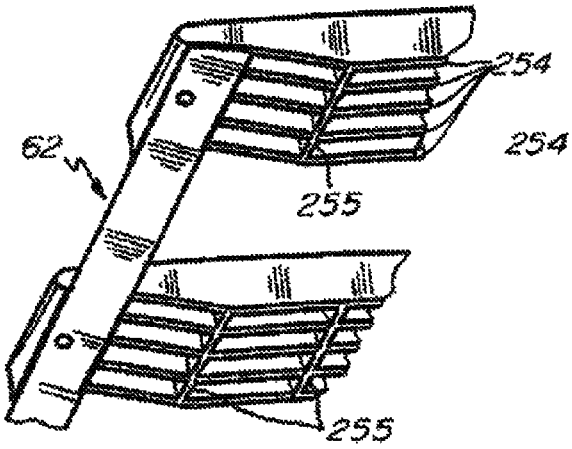
FIGS. 19A and 19B are enlarged partial bottom perspective views of FIG. 19.
Figure 19B:
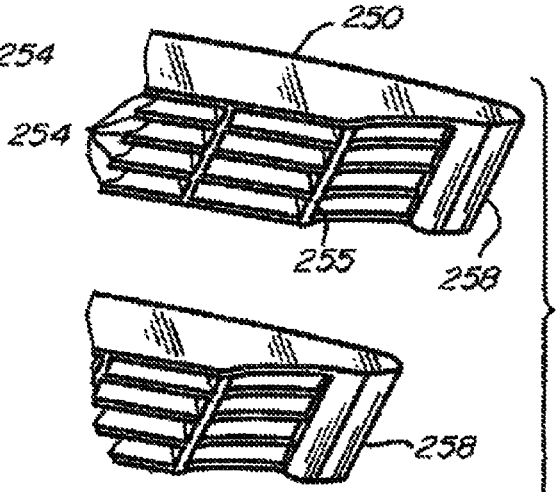

As depicted, for example, in FIGS. 19 and 22, the elongate slat members 250, 260 define an arcuate profile 280 that is convex in an upward direction as viewed in from the side (i.e., as viewed in the lateral direction 86). Accordingly, a local maxima 281 between the forward edge structure 62 and the rearward edge structure 64. (Herein, several embodiments for the rearward edge structure are presented, referred to collectively or generically as rearward edge structure 64 and individually by reference numeral 64, followed by a letter suffix (e.g., "64*a*").)

Figure 25A:
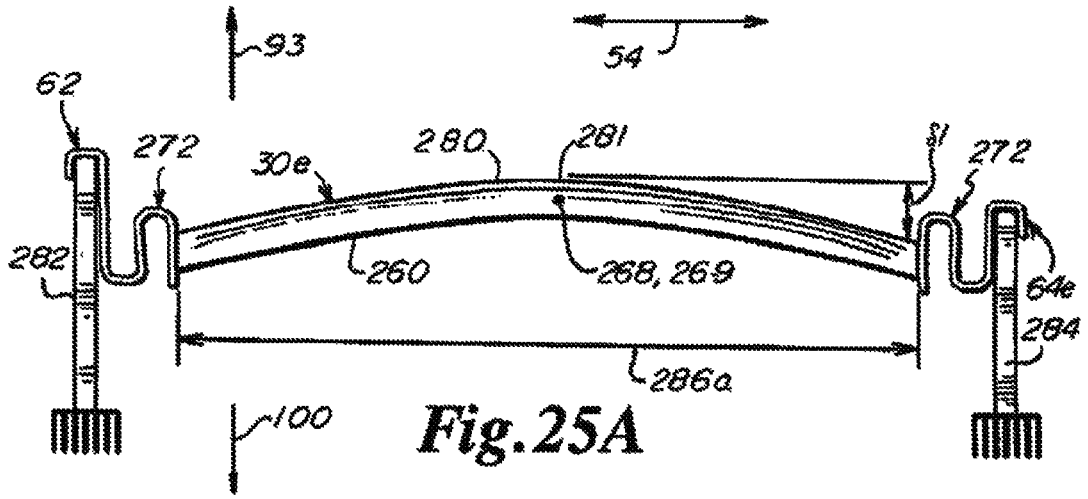
FIGS. 25A through 25C is a schematic depiction of a seat deck implementing S-shaped flexures in operation in an embodiment of the disclosure.
Figure 25B:
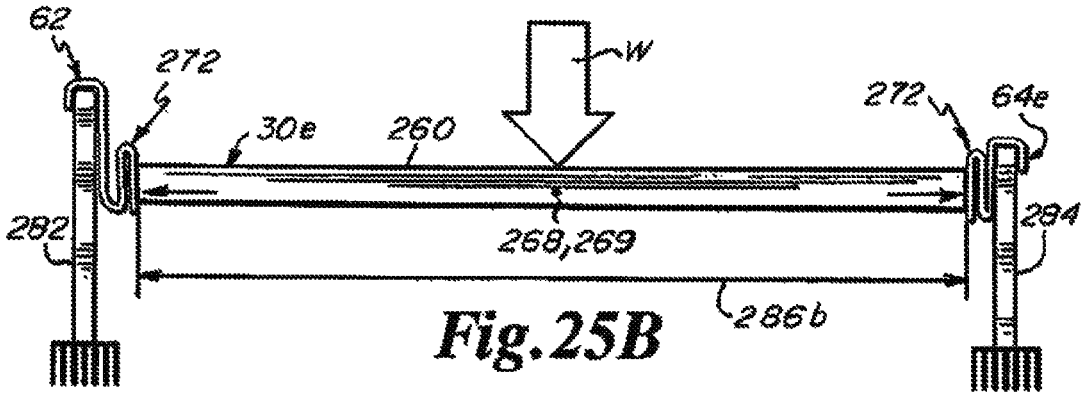
Figure 25C:
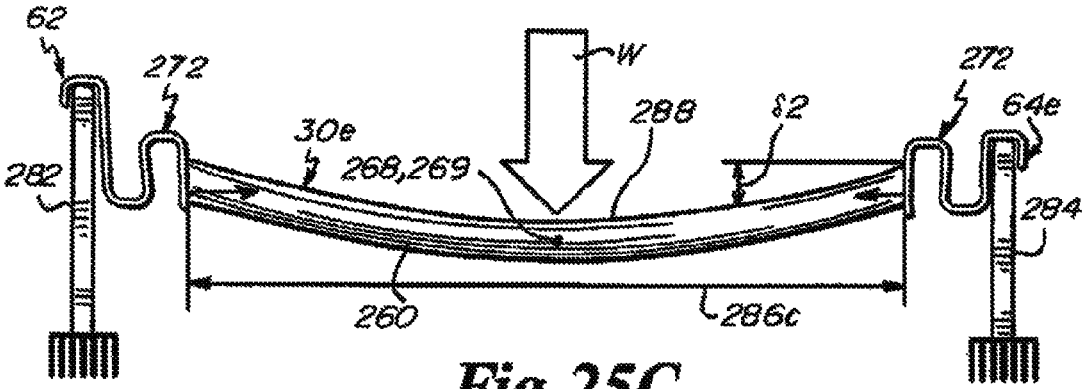

Referring to FIGS. 25A through 25C, operation of the seat deck 30*e* is schematically depicted in an embodiment of the disclosure. The schematics of FIG. 25A through 25C depict forward and rearward support members 282 and 284 as being in fixed relation to each other. The seat deck 30*e* is depicted initially in an unloaded state and defining a span length 286*a* between the flexures 270 (S-shaped flexures 272) that is characterized as having a maximum arc height or convex dimension 61 (FIG. 25A). Upon application of a weight W, the arcuate profile 280 initially becomes less pronounced as the center of the elongate slat members 260 deflect downward. The downward deflection also causes the span to increase. At some point, the elongate slat members 260 become substantially flat; at such point, a maximum span length 286*b* is attained and the compression of the S-shaped flexures 272 is maximized (FIG. 25B).

If there is enough weight, the elongate slat members 260 can undergo a profile inversion; that is, instead of defining a convexity in the upward direction 93, the elongate slat members define a convexity in the downward direction 100 (i.e., a concavity with respect to the upward direction 93). As the elongate slat members 260 pass through a substantially flat profile and transition to an inverted profile 288, the span length decreases, and the lateral compression of the S-shaped flexures 272 becomes less. It is contemplated the inverted profile may define a concavity that is greater than the convexity of the unloaded state (FIG. 25C). That is, a maximum concave dimension 62 in the loaded state is greater than the maximum convex dimension 61 in the unloaded state. When the maximum concave dimension 62 exceeds the maximum convex dimension 61, a span length 286*c* is smaller than both span lengths 286*a* and 286*b*, the force component on the S-shaped flexures 272 in the fore-and-aft directions 54 is reversed, and the S-shaped flexures 272 of the seat deck 60*e* are placed in tension.

Accordingly, the flexures 270 (S-shaped flexures 272) of the seat deck 60*e* accommodate the change in the span lengths 286*a* through 286*c*.

Figure 26:
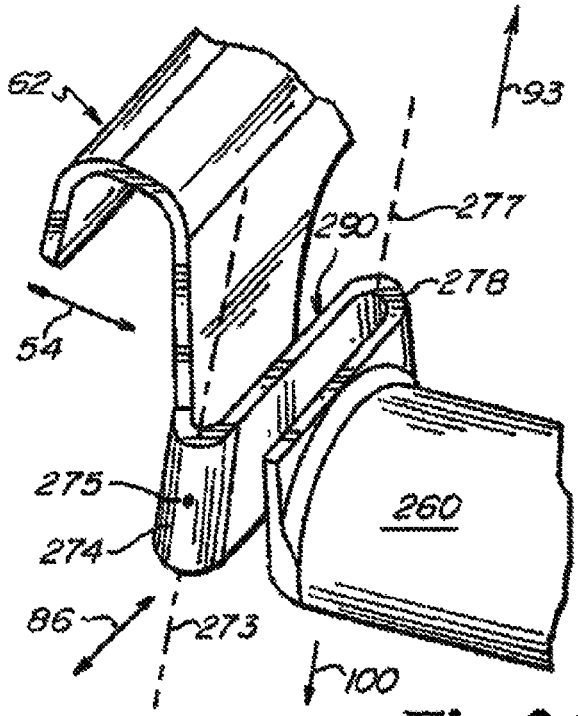
FIG. 26 is an enlarged, perspective view of an alternative S-shaped flexure and channel arrangement in an embodiment of the disclosure.

Referring to FIG. 26, a laterally oriented S-shaped flexure 290 is depicted in an embodiment of the disclosure. The laterally oriented S-shaped flexure 290 includes the same aspects as the S-shaped flexures 272, but is oriented so that the first bend 274 and the second bend 278 are convex in opposed lateral directions 86, and the first and second flexure axes 273 and 277 are substantially parallel to the upward and downward directions 93 and 100. In terms of accommodating the fore-and-aft changes in the span lengths 286*a* through 286*c* of FIG. 25, the laterally oriented S-shaped flexure 290 operates the same as the S-shaped flexures 272. The laterally oriented S-shaped flexure 290 can be tailored for more or less deflection in the downward direction 100; that is, a wider laterally oriented S-shaped flexure 290 will be stiffer in the downward direction 100 than a narrower laterally oriented S-shaped flexure 290.

The S-shaped flexures 272 and 290 present the first and second flexure axes 273 and 277 as being parallel to the lateral directions 86 and the upward direction 93, respectively, and orthogonal to the fore-and-aft directions 54. It is noted that these arrangements are non-limiting. That is, the S-shaped flexure geometry can be oriented in any arbitrary orientation. For example, the first and second flexure axes 273 and 277 can be orthogonal to the fore-and-aft directions 54 and at an arbitrary angle between the lateral directions 86 and the upward direction 93. Also, orientations that are non-orthogonal to the fore-and-aft directions 54 are contemplated.

In various embodiments, the S-shaped flexures 272 and laterally oriented S-shaped flexure 290 have a thickness in the range of 1 mm to 5 mm inclusive; in some embodiments, the thickness is in the range of 1.5 mm to 3 mm inclusive. In some embodiments, the flexures 272, 290 are of substantially uniform thickness. In various embodiments, the flexures 272, 290 have a width in the range of 25 mm to 75 mm inclusive; in some embodiments, the width is in the range of 40 mm to 60 mm inclusive. In various embodiments, the minimum (inside) radius of the first and second bends 274 and 278 is in the range of 3 mm to 15 mm inclusive; in some embodiments, the minimum radii of the bends 274 and 278 are in the range of 6 mm to 9 mm inclusive.

Figure 27:
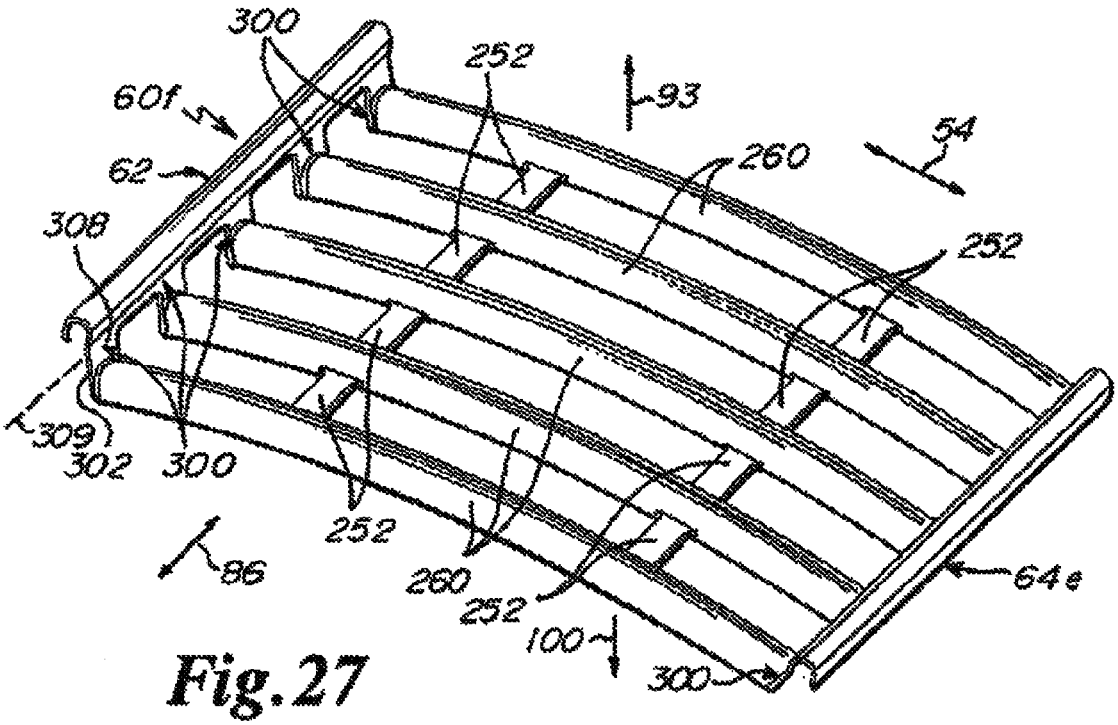
FIG. 27 is a top perspective view of a seat deck in an embodiment of the disclosure.
Figure 28:
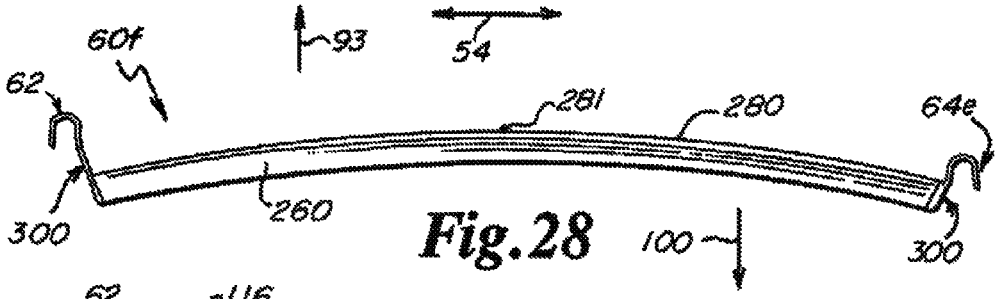
FIG. 28 is an elevational view of the seat deck of FIG. 27.
Figure 28A:
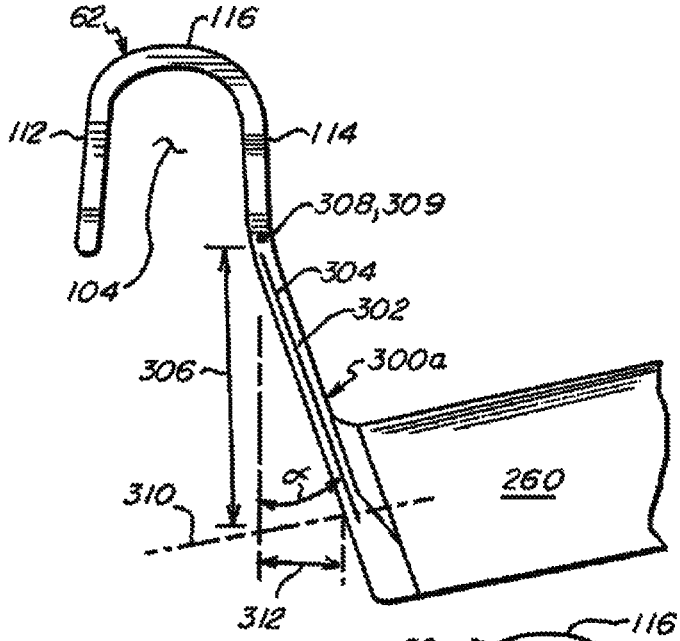
FIG. 28A is an enlarged view of a canted arm flexure of the seat deck of FIG. 28.
Figure 28B:
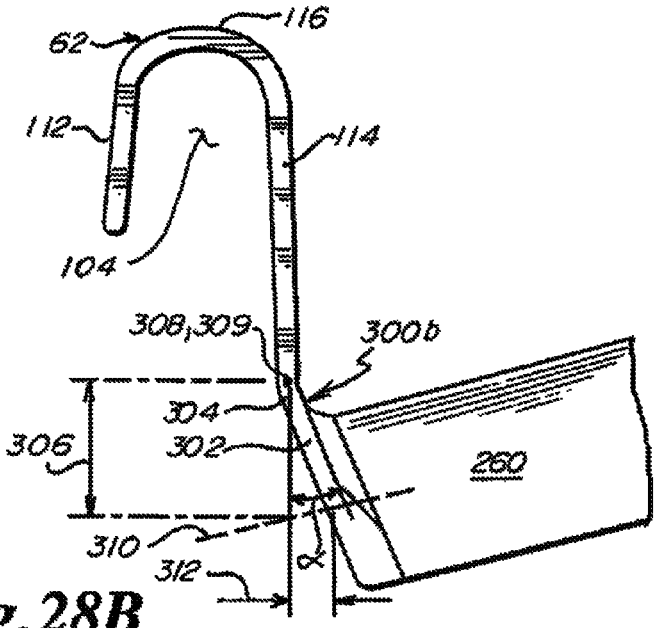
FIG. 28B is an enlarged view of an alternative canted arm flexure of a seat deck in an embodiment of the disclosure.

Referring to FIG. 27 through 28B, a seat deck 60*f* including canted arm flexures 300 are depicted in an embodiment of the disclosure. The seat deck 60*f* includes some of the same aspects and attributes as the seat decks 60*e*, indicated with same- or like-numbered numerical references. Like seat deck 60*e*, the seat deck 60*e* includes: elongate slat members 260 that extend in the fore-and-aft directions 54 and are tied together with lateral tie members 252; forward and rearward edge structures 62 and 64*e*, each defining the channel 104; and flexures 270 bridging the elongate slat members 260 and the forward and rearward edge structures 62 and 64*e*, the flexures 270 being configured to flex in the fore-and-aft directions 54. However, instead of S-shaped flexures 272, the canted arm flexures 300 are utilized.

The canted arm flexures 300 include an arm or plate 302 that projects from the forward or rearward edge structures 62 or 64*e* at an acute angle α relative to the downward direction 100. The acute angle α defines a maximum angular deflection that the arm 302 can undergo before registering against the forward or rearward support 282 or 284. An apex 304 of the acute angle α also defines a node 308 and flexure axis 309 (FIG. 27) in the arm 302. In the depicted embodiment of FIGS. 27 through 28B, the flexure axis 309 is substantially parallel to the lateral directions 86. A vertical distance 306 between the node 308 and a neutral axis 310 of the elongated slat member 260 defines a maximum lateral deflection 312 that the canted arm flexure 300 can accommodate. The shorter the vertical distance 306, the less the maximum lateral deflection 312 that can be accommodated by the canted arm flexure 300 (FIGS. 28A and 28B).

Herein, two configurations of the canted arm flexure 300 are presented, referred to generically or collectively as canted arm flexure(s) 300 and individually as canted arm flexures 300*a* and 300*b*, presented in FIGS. 28A and 28B respectively. The canted arm flexures 300*a* and 300*b* represent examples of varying the maximum lateral deflection 312. The vertical distance 306 is greater in FIG. 28A than in FIG. 28B; hence, the maximum lateral deflection 312 is less in FIG. 28B than in FIG. 28A.

Functionally, flexing of the canted arm flexures 300 occurs primarily about the node 308 and flexure axis 309. The maximum lateral deflection 312 can be tailored to provide a stop for the deflection. That is, the seat deck 30*f* can define a maximum lateral deflection 312 that does not fully accommodate the maximum potential displacement of the elongate slat members 260 in the fore-and-aft directions 54 (e.g. the maximum span length 286*b* of FIG. 25B). In such a configuration, the canted arm flexures 300 would stop against the respective forward or rearward support members 282 or 284, thereby arresting the deflection of the elongate slat members 260 before the elongate slat members 260 become substantially flat or undergoing a profile inversion. In other embodiments, the maximum lateral deflection 312 can be tailored so that the canted arm flexures 300 do not stop against the support members 282, 284.

The canted arm flexures 300*a* and 300*b* present the flexure axis 309 as being parallel to the lateral directions 86 and orthogonal to the fore-and-aft directions 54. It is noted that this arrangement is non-limiting. That is, the canted arm flexure geometry can be oriented in several arbitrary orientations. For example, flexure axis 309 can be orthogonal to the fore-and-aft directions 54 and at an arbitrary angle between the lateral directions 86 and the upward direction 93. Also, orientations that are non-orthogonal to the fore-and-aft directions 54 are contemplated.

Figure 29A:
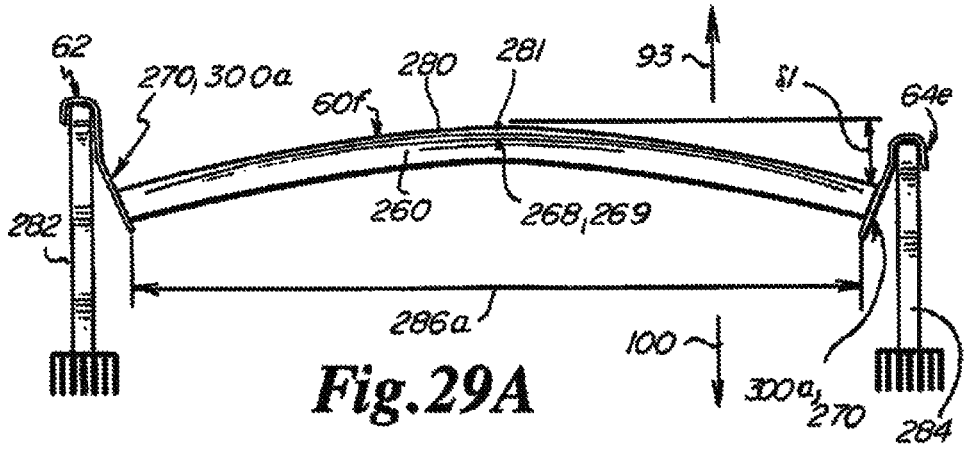
FIGS. 29A through 29C is a schematic depiction of a seat deck implementing canted arm flexures in operation in an embodiment of the disclosure.
Figure 29B:
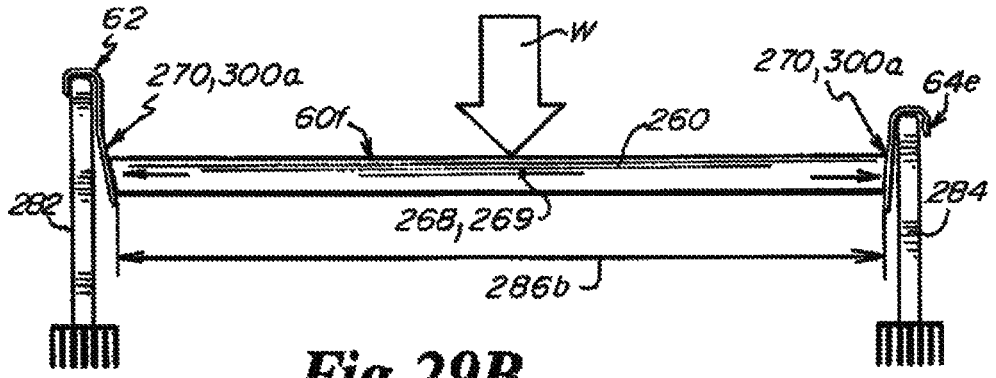
Figure 29C:
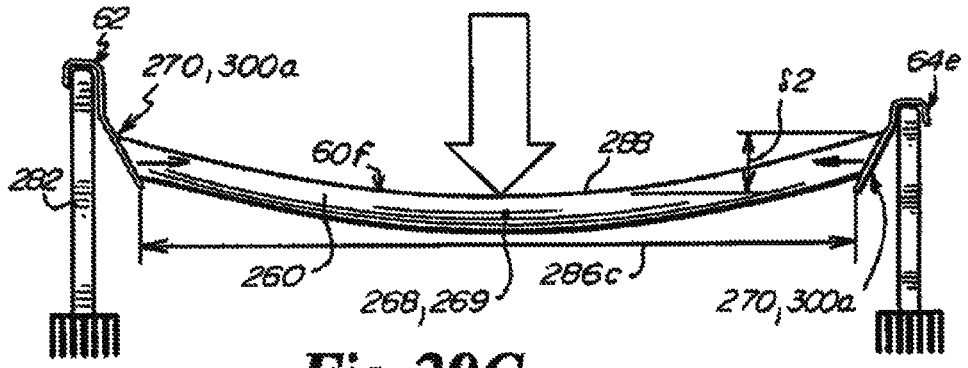

Referring to FIGS. 29A through 29C, operation of the seat deck 30*f* utilizing the canted arm flexures 300*a* of FIG. 28A is schematically depicted in an embodiment of the disclosure. The schematics of FIGS. 29A through 29C include many of the same aspects and attributes as FIGS. 25A through 25C, which are identified with same-numbered numerical references. The seat deck 30*f* is depicted initially in an unloaded state and defining the span length 286*a* between the flexures 270 (canted arm flexures 300*a*) (FIG. 29A). Upon application of the weight W, the arcuate profile 280 initially becomes less pronounced as the center of the elongate slat members 260 deflect downward. The downward deflection also causes the span length to increase. At some point, if the canted arm flexures 300*a* are configured to accommodate the maximum fore-and-aft extension of the elongate slat members 260, the slat members 260 become substantially flat; at such point, the maximum span length 286*b* is attained and the deflection of the flexures 300*a* is maximized (FIG. 29B).

If there is enough weight, the elongate slat members 260 can undergo a profile inversion; that is, instead of defining a convexity in the upward direction 93, the elongate slat members define a convexity in the downward direction 100 (i.e., a concavity with respect to the upward direction 93). As the elongate slat members 260 pass through the substantially flat profile to the inverted profile, the span length decreases, and the lateral deflection of the canted arm flexures 300*a* becomes less. It is contemplated the inverted profile may define a concavity that is greater than the convexity of the unloaded state (FIG. 29C). That is, a maximum concave dimension 62 in the loaded state is greater than the maximum convex dimension 61 in the unloaded state. When the maximum concave dimension 62 exceeds the maximum convex dimension 61, a span length 286*c* is smaller than both span lengths 286*a* and 286*b*, the force component on the canted arm flexures 300*a* in the fore-and-aft directions 54 is reversed. The canted arm flexures 300 of the seat deck 60*f* are then deflected inward relative to the unloaded state.

Accordingly, the canted arm flexures 300*a* of the seat deck 60*f* can be configured to accommodate the change in the span lengths 286*a* through 286*c*.

Figure 30A:
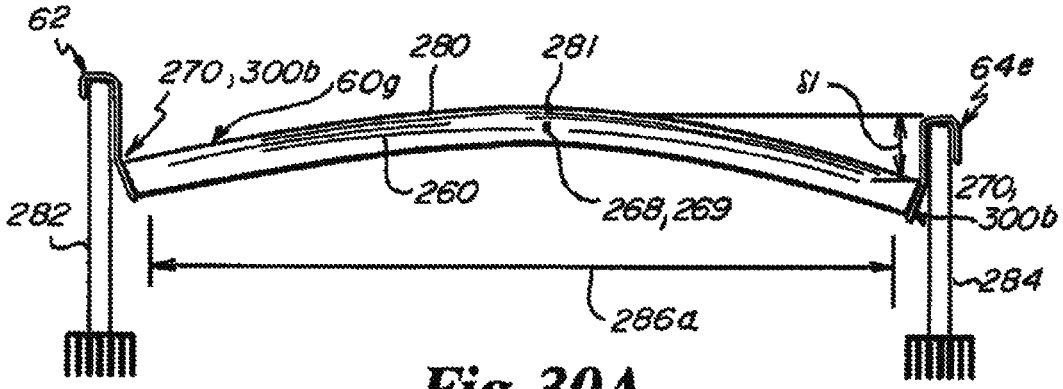
FIGS. 30A and 30B is a schematic depiction of a seat deck implementing alternative canted arm flexures in operation in an embodiment of the disclosure.
Figure 30B:
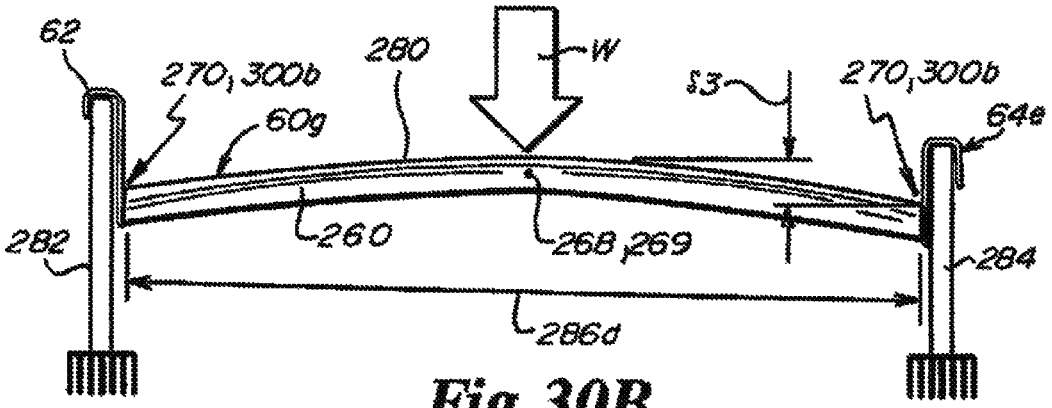

Referring to FIGS. 30A and 30B, operation of a seat deck 30*g* utilizing the canted arm flexures 300*b* of FIG. 28B is schematically depicted in an embodiment of the disclosure. The seat deck 30*g* and schematics of FIGS. 30A and 30B include many of the same aspects and attributes as the seat deck 30*f* and FIGS. 29A through 29C, which are identified with same-numbered numerical references. The seat deck 30*g* is depicted initially in an unloaded state and defining the span length 286*a* between the flexures 270 (canted arm flexures 300*b*) (FIG. 29A). Upon application of the weight W, the arcuate profile 280 initially becomes less pronounced as the center of the elongate slat members 260 deflect downward. The downward deflection also causes the span length to increase. At some point, if the canted arm flexures 300 are configured to provide a stop as discussed above, the arms 302 of the canted arm flexures 300 flatten out or are pressed against the respective supports 282 and 284 before the elongate slat members 260 become substantially flat; at such point, a minimum convex dimension 63 of the arcuate profile 280 is attained (FIG. 30B), but the supports 282 and

284 act as stops that prevent a span length 286*d* of the elongate support members 260 from extending further. It is noted that additional weight may cause additional distortion and deflection of the elongate slat members 260 and/or the framework 30, but not in the manner depicted in FIGS. 29A through 29C.

Accordingly, the canted arm flexures 300 of the seat deck 60*g* can be configured to provide a stop that limits the span length and the subsequent deflection of the elongate slat members 260.

Figure 31:
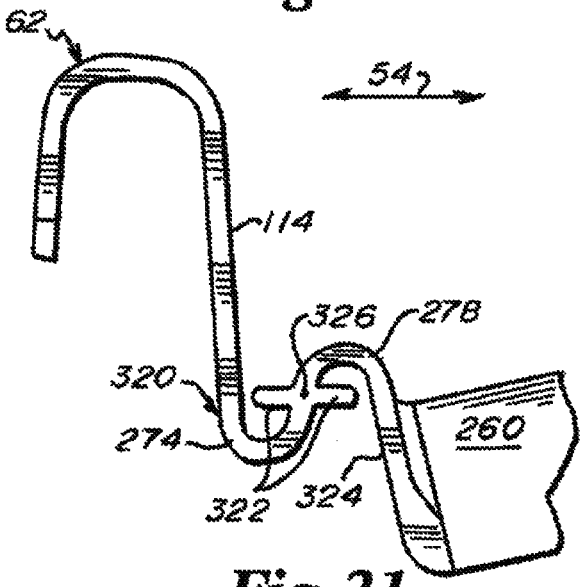
FIG. 31 is an elevational view of an S-shaped flexure including stop protrusions in an embodiment of the disclosure.

Referring to FIG. 31, an S-shaped flexure 320 including stop protrusions 322 is depicted in an embodiment of the disclosure. In the depicted embodiment, the protrusions 322 extend in the fore-and-aft directions 54 within the S-shaped structure of the S-shaped flexure 320 proximate a junction 326 of the first bend 274 and the second bend 278. In operation, when the S-shaped flexure 320 undergoes sufficient compressive deflection, the protrusions 322 make contact with the flange portion 114 of the edge structure 62 or 64*e* and a face 324 of the elongate slat member 260. This contact functions to stop or inhibit further compression of the S-shaped flexure 320. Accordingly, the protrusions 322 serve as a stop that can limit or arrest the deflection of the elongate slat members 260 to a minimum convex dimension before the elongate slat members 260 become substantially flat. While the protrusions 322 are depicted as extending from the junction, it is understood that protrusions can extend from other components of the seat deck to the same effect, for example from the face 324 of the elongate slat member 260, and/or from the flange portion 114.

Alternatively, the S-shaped flexures 272 can be configured so that the minimum bend radii R1 and R2 are small enough so that the S-shaped flexures 272 collapses onto itself before the elongate slat member becomes substantially flat. The S-shaped flexures 272 is said to "collapse onto itself" when the second bend 278 makes contact with, for example, the flange portion 114 and the first bend 274 makes contact with, for example, the elongate slat member 260.

It is noted and acknowledged that the various flexures 270, 272, 290, 320 will deflect in the downward direction 100 upon application of the weight W. The depictions herein do not represent the downward deflections of the flexures for the sake of simplicity of illustration.

The seat decks 60 can be fabricated from a variety of materials, including metals and polymers. In various embodiments, the seat deck is injection molded and can comprise a composite material. In one embodiment, the composite material comprises a 10% to 20% glass filled polypropylene. Other fillers can include talc and calcium. Other materials contemplated include, but are not limited to, thermoplastic elastomers, resins, acetal, and acrylics. In one embodiment, the composite material includes a dry, lubricious material, such as polytetrafluoroethylene (PTFE) to provide lubricity between the free end of the seat deck and the upward-facing registration surface.

The foregoing discussion is directed to sofa frames and assemblies. Those of skill in the relevant art will recognize that the same concepts and aspects can be utilized in other furnishings, including, but not limited to, single seat chairs and love seats.

Each of the additional figures and methods disclosed herein can be used separately, or in conjunction with other features and methods, to provide improved devices and methods for making and using the same. Therefore, combinations of features and methods disclosed herein may not be necessary to practice the disclosure in its broadest sense and are instead disclosed merely to particularly describe representative and preferred embodiments.

Various modifications to the embodiments may be apparent to one of skill in the art upon reading this disclosure. For example, persons of ordinary skill in the relevant art will recognize that the various features described for the different embodiments can be suitably combined, uncombined, and re-combined with other features, alone, or in different combinations. Likewise, the various features described above should all be regarded as example embodiments, rather than limitations to the scope or spirit of the disclosure.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A furniture assembly, comprising:

a seating frame including a first support member and a second support member, said first support member and said second support member being substantially parallel and extending in a lateral direction; and a seat deck comprising a composite polymer material and including a first edge structure and a second edge structure, said first edge structure defining a channel dimensioned to capture an upper edge of said first support member, said first edge structure being fixedly attached to said first support member of said furniture assembly, said seat deck including an elongated slat member that is coupled to said first edge structure and said second edge structure, said elongated slat member extending between said first edge structure and said second edge structure in a fore-and-aft direction that is perpendicular to said lateral direction, wherein said elongate slat member defines a convex arcuate profile that is convex in an upward direction, said convex arcuate profile defining a local maxima of said elongate slat member, wherein said elongated slat member is one of a plurality of elongated slat members of said seat deck, said plurality of elongated slat members extending in said fore-and-aft direction, said seat deck including lateral tie members that tie said plurality of elongated slat members together in said lateral direction, said plurality of elongated slat members being unitary with said second edge structure wherein said second edge structure defines a channel dimensioned to capture an upper edge of said second support member, said second edge structure being fixedly attached to said second support member of said furniture assembly, wherein said seat deck includes flexures that bridge said elongated slat member to said first edge structure and said second edge structure, said flexures being configured to accommodate a change in a length of said elongated slat member of the seat deck in said fore-and-aft directions when said seat deck is under a weight load.

2. The furniture assembly of claim 1, wherein said composite polymer material comprises a 10% to 20% glass filled polypropylene.

3. The furniture assembly of claim 1, wherein the furniture assembly is a sofa.

4. The furniture assembly of claim 1, wherein said flexures are configured to accommodate a maximum change in said length of said elongated slat member of said seat deck in said fore-and-aft directions, thereby enabling said elongated slat member to transition from said convex arcuate profile to an inverted profile that defines a concavity.

5. The furniture assembly of claim 1, wherein at least one of said flexures defines a node and a flexure axis that passes through said node, said flexure being configured to flex about said node and said flexure axis when a force component is exerted on said at least one of said flexures in said fore-and-aft directions.

6. The furniture assembly of claim 5, wherein said flexure axis is orthogonal to said fore-and-aft directions.

7. The furniture assembly of claim 6, wherein said flexure axis is substantially parallel to said lateral direction.

8. The furniture assembly of claim 5, wherein said at least one of said flexures defines a second node and a second flexure axis that passes through said second node, said at least one of said flexures being configured to flex about said second node and said second flexure axis when said force component is exerted on said at least one of said flexures in said fore-and-aft directions.

9. The furniture assembly of claim 8, wherein said second flexure axis is parallel to said flexure axis.

10. The furniture assembly of claim 9, wherein said at least one of said flexures is an S-shaped flexure.

11. The furniture assembly of claim 5, wherein said at least one of said flexures is configured to provide a stop in the fore-and-aft directions to limit deflection of said elongated slat member in a downward direction.

12. The furniture assembly of claim 5, wherein said at least one of said flexures is a canted arm flexure configured to stop against said seating frame to limit deflection of said elongated slat member in a downward direction.

* * * * *